US008047110B2

(12) United States Patent
Pappas et al.

(10) Patent No.: US 8,047,110 B2
(45) Date of Patent: Nov. 1, 2011

(54) POSITIONING SYSTEM AND CARRIAGE ASSEMBLY FOR CONVERTING MACHINES

(75) Inventors: Michael Pappas, Denville, NJ (US); William Christman, Boonton, NJ (US)

(73) Assignee: Catbridge Machinery, L.L.C., Parsippany, NJ (US)

( * ) Notice: Subject to any disclaimer, the term of this patent is extended or adjusted under 35 U.S.C. 154(b) by 348 days.

(21) Appl. No.: 11/314,390

(22) Filed: Dec. 21, 2005

(65) Prior Publication Data

US 2006/0162519 A1 Jul. 27, 2006

Related U.S. Application Data

(60) Provisional application No. 60/640,032, filed on Dec. 29, 2004, provisional application No. 60/728,984, filed on Oct. 21, 2005.

(51) Int. Cl.
*B26D 7/26* (2006.01)

(52) U.S. Cl. ..... 83/481; 83/76.1; 83/425.4; 83/503

(58) Field of Classification Search ..... 83/477.1, 83/508.2, 508.3, 863, 864, 882–885, 563, 83/435, 870, 872, 873, 72, 76.6, 425.2–425.4, 83/495–507; 493/365, 367, 64, 65; 225/3
See application file for complete search history.

(56) References Cited

U.S. PATENT DOCUMENTS 1,360,076 A * 11/1920 Bassaler ..... 493/370
4,122,957 A * 10/1978 Allen et al. ..... 414/281
4,275,631 A 6/1981 Wingen
4,434,695 A 3/1984 Wingen
4,561,335 A 12/1985 Wingen
4,684,360 A * 8/1987 Tokuno et al. ..... 493/367
4,989,486 A 2/1991 Miller et al.
4,996,898 A 3/1991 Miller et al.
5,125,300 A 6/1992 Miller et al.
5,125,301 A 6/1992 Miller et al.
5,237,900 A 8/1993 Supe-Dienes et al.

(Continued)

FOREIGN PATENT DOCUMENTS

DE 198 37 370 A 12/1999

(Continued)

OTHER PUBLICATIONS

Communication re Allowance of Application referencing Application No. EP 05 028 669.9-2302.

(Continued)

*Primary Examiner* — Phong Nguyen
(74) *Attorney, Agent, or Firm* — Edwards Angell Palmer & Dodge LLP

(57) ABSTRACT

A system for slitting a web includes a carriage assembly having an elongate housing including a first wall, where the first wall defining a longitudinal axis. A first plurality of rails can be mounted on the first wall, wherein the plurality of rails extends parallel to the longitudinal axis. At least one of the plurality of rails can have a substantially circular cross section, among others. The system also includes a first plurality of carriers. Each carrier can be adapted and configured to support an instrumentality such as a blade for performing an operation (e.g., cutting) on a web of material. The carrier body includes a first body portion and a second body portion. Each of body portion includes at least one mounting feature for mounting the carrier on a the plurality of rails.

67 Claims, 19 Drawing Sheets

U.S. PATENT DOCUMENTS

| | | | | |
|---|---|---|---|---|
| 5,373,642 | A | 12/1994 | Supe-Dienes | |
| 5,546,840 | A | 8/1996 | Supe-Dienes | |
| 5,735,184 | A | 4/1998 | Miller et al. | |
| 6,079,662 | A | 6/2000 | Miller et al. | |
| 6,165,117 | A * | 12/2000 | Adami | 493/365 |
| 6,227,092 | B1 | 5/2001 | Ivel et al. | |
| 6,327,950 | B1 | 12/2001 | Huhn et al. | |
| 6,732,625 | B1 | 5/2004 | Boynton et al. | |
| 2004/0159693 | A1 * | 8/2004 | Adachi et al. | 225/3 |

FOREIGN PATENT DOCUMENTS

| | | | |
|---|---|---|---|
| DE | 199 04 182 | A1 | 8/2000 |
| DE | 199 54 454 | A1 | 5/2001 |
| DE | 102 05 994 | A1 | 6/2003 |
| DE | 202 20 658 | U | 5/2004 |

OTHER PUBLICATIONS

Hoefer & Partner's response to Office Action filed Aug. 21, 2007 in reply to communication dated May 23, 2007 referencing Application No. EP 05 028 669.9-2302.

European Office Action dated May 23, 2007 referencing Application No. EP 05 028 669.9-2302.

Hoefer & Partner's response to Office Action filed May 7, 2007 in reply to communication dated Nov. 11, 2008 referencing Application No. EP 05 028 669.9-2302.

Hoefer & Partner's response filed Oct. 4, 2006 referencing Application No. EP 05 028 669.9-2302.

European Office Action dated Aug. 11, 2006 referencing Application No. EP 05 028 669.9-2302.

European Search Report, Mar. 21, 2006.

* cited by examiner

PRIOR ART

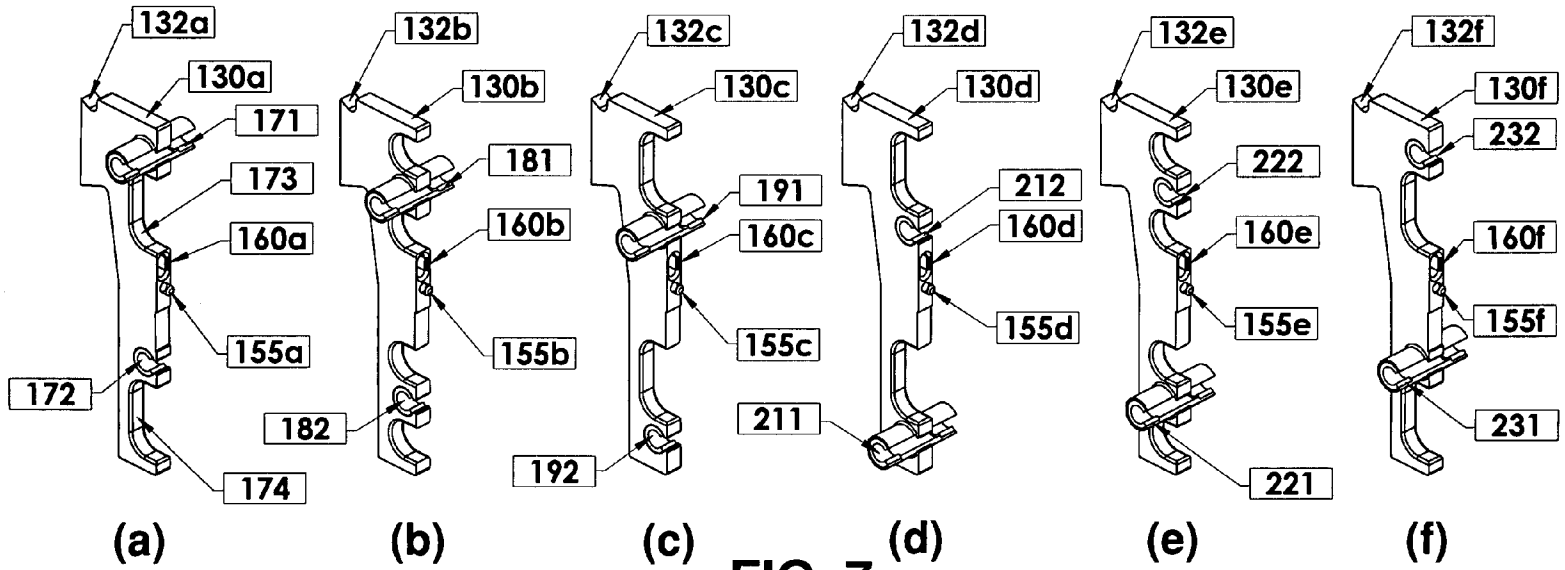
FIG. 7
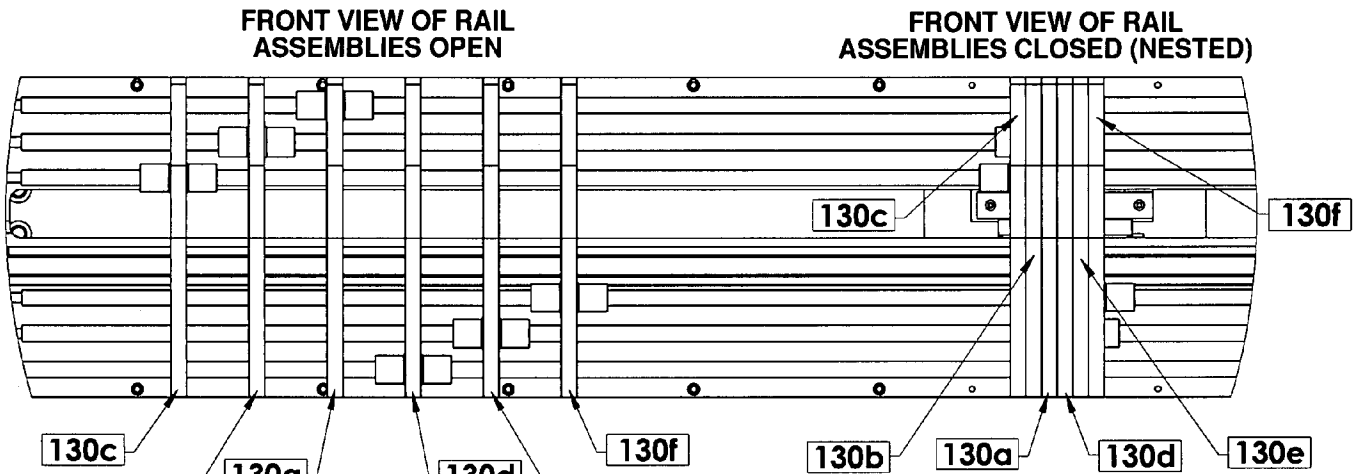
FIG. 8b
FIG. 8a

POSITIONING SYSTEM AND CARRIAGE ASSEMBLY FOR CONVERTING MACHINES

CROSS-REFERENCE TO RELATED APPLICATIONS

This patent application claims priority to Provisional Patent Application Ser. No. 60/640,032, filed Dec. 29, 2004 and Provisional Patent Application Ser. No. 60/728,984, filed Oct. 21, 2005, the entirety of each application being incorporated by reference herein.

BACKGROUND OF THE INVENTION

1. Field of the Invention

The subject invention relates to converting machinery, and more particularly to, a carriage assembly and an automated knife positioning system for score slitting machines, razor slitting machines and shear slitting machines.

2. Description of Related Art

For decades the converting industry has been employing score slitting machinery to convert webs of paper, foam, fabrics, nonwovens, tape and other materials into desired widths. A prior art score slitting machine for processing media is illustrated in FIG. 1 and is designated generally by reference numeral 10.

Referring to FIG. 2, slitting machine 10 includes a hardened score roll 12 against which media is slit or otherwise cut into desired widths, as the media is conveyed from an unwind which supports a web of uncut media to a rewind which accumulates the media after it has been cut into the desired widths. Slitting machine 10 further includes a carriage assembly 14 for supporting a plurality of score knives for slitting the media into desired widths.

More particularly, carriage assembly 14, as is known in the prior art, supports a plurality of pneumatic knife holders 16 on a horizontal support bar 18 in spaced relationship. The knife holders vary in size, but the most common knife holders are ½" wide. Dozens of knife holders can be positioned on the support bar at one time to perform a slitting operation.

The support bar 18 has a dovetail configuration, as best seen in FIG. 2, which facilitates the ready removal and manual positioning of the knife holders 16 in a desired location by way of clamping screw 20. Each knife holder 16 carries a rotary score knife 22 and is connected to a common air manifold 24 by way of an air hose 26. In use, air pressure is applied to the knife holders 16 and regulated to achieve a desired cutting pressure against the score roll 12.

There are certain limitations associated with prior art score slitting machines. One such limitation is the significantly long set up time that is required to manually position the score knives on the support bar and ensure the accurate placement thereof. Another limitation specifically related to prior art automated knife positioning systems is that the slit width that can be achieved is generally limited by the set up distance that is required between adjacent knife holders mounted on the support bar. Thus, there is a minimum slit width that can be achieved with automated knife positioning systems on prior art slitting machines that is insufficient for many converting applications.

Clearly there is a need for a carriage assembly for knife holders that can overcome the limitations of prior art slitting machines, and that can be readily employed with other types of converting machines, including razor slitting machines and shear slitting machines.

SUMMARY OF THE INVENTION

The purpose and advantages of the present invention will be set forth in and apparent from the description that follows, as well as will be learned by practice of the invention. Additional advantages of the invention will be realized and attained by the methods and systems particularly pointed out in the written description and claims hereof, as well as from the appended drawings.

To achieve these and other advantages and in accordance with the purpose of the invention, as embodied herein and broadly described, the invention includes a carrier for supporting a blade for a converting machine. The carrier includes a carrier body. The carrier body is adapted and configured to support a blade for performing an operation (e.g., cutting) on a web of material. The carrier body includes a first body portion and a second body portion. Each of the first body portion and second body portion includes at least one mounting feature adapted and configured for mounting the carrier on a first rail and second rail, respectively.

In accordance with a further aspect of the invention, each carrier can be provided with a plurality of rail positions that can be positioned proximate a mounting rail on a converting machine. For example, the first body portion and second body portion can be provided with first through second rail positions and third through fourth rail positions, respectively. At least one mounting feature of the first body portion and second body portion can be positioned at one of the first or second rail positions and third or fourth rail positions, respectively.

In accordance with a further aspect, the first body portion and second body portion can be provided with first through third rail positions and fourth through sixth rail positions, respectively. At least one mounting feature of the first body portion and second body portion can be positioned at one of the first through third and fourth through sixth rail positions, respectively. The first body portion can define at least one recess for accommodating at least one rail therethrough. The recess can be located in at least one of the first, second and third rail positions. For example, the mounting feature can be located at the first rail position, and the recess spans the second and third rail positions.

By way of further example, the second body portion can include fourth, fifth and sixth rail positions, and the at least one mounting feature of the second body portion can be positioned at one of the fourth, fifth and sixth rail positions. The second body portion can include at least one recess for accommodating at least one rail, the recess being located in at least one of the first through third rail positions. For example, the mounting feature can be located at the fifth rail position, and the second body portion can include recesses at the fourth and sixth rail positions.

In accordance with a further aspect, the carrier embodied herein can further include a blade. For example, the blade can be chosen from the group consisting of razor blades, shear slitting blades and score slitting blades. In accordance with this aspect, the carrier can further include a blade holder for supporting the blade. The carrier body may further define a mounting flange for supporting the blade holder. By way of example, the mounting flange can be a dovetailed mounting flange for supporting an industry standard blade holder. Alternatively, the blade holder and carrier body may be integrally formed. The carrier body further includes a medial body portion disposed between the first body portion and the second body portion. The mounting flange can be disposed on any of the upper, medial and second body portions. As used herein, the terms first body portion and second body portions are merely for matter of convenience. The carriers embodied herein can be adjusted to be in any vertical or horizontal orientation, and the terms upper and lower can, in fact, relate to right and left body portions, first and second body portions, and the like.

In accordance with still a further aspect, at least one mounting feature can be a first bushing affixed to the upper and/or second body portion one of the rail locations. If desired, the first bushing can be received inside a mounting sleeve integral with the first body portion. Alternatively, the first bushing can be removably attached to the first body portion by way of one or more threaded fasteners. The first bushing can be provided with an axial length that is coextensive with or greater than a width of the carrier body. In accordance with one embodiment, the first bushing can have an axial length that is about five times the width of the carrier body. The bushing can be made from a different material than the carrier body. Moreover, the carrier body can be made from a harder material than the bushing. For example, the carrier body can be made from steel, and the bushing can be made from a material chosen from the group consisting of bronze, nylon and a fluoropolymer. By way of further example, the carrier can also include ball bearings disposed within at least one of the mounting features.

In accordance with still a further aspect, the carrier can include various features. For example, the carrier can include a marker disposed on the carrier body for indicating a position of the carrier on the plurality of rails. Specifically, the marker can be an optical marker or a magnetic marker, among others. Moreover, the carrier can also include a positioner receiving portion disposed on the carrier body for receiving a portion of a positioner. In accordance with one embodiment, the positioner receiving portion may define a concavity for receiving a rounded portion of the positioner.

In accordance with a further aspect, a system for performing an operation on a web of material, such as slitting, is provided. The system includes a carriage assembly having an elongate housing including a first wall, where the first wall defining a longitudinal axis. A first plurality of rails can be mounted on the first wall, wherein the plurality of rails extends parallel to the longitudinal axis. At least one of the plurality of rails can have a substantially circular cross section, among others. The system also includes a first plurality of carriers such as those described hereinabove.

In accordance with a further aspect, a portion of a bushing of a first carrier can be received by a recess on a second adjacent carrier. Adjacent carriers mounted on rails adjacent the first wall can be placed in close proximity to one another. For example, a blade provided on the first carrier can be mounted within half an inch of a blade on the second carrier.

In accordance with a further aspect of the system, a linear actuator having a positioner operatively associated with the elongate housing can be provided. By way of example, the linear actuator can include a drive for displacing the positioner along a direction of travel. The positioner may be adapted and configured to selectively position at least a first carrier of the first plurality of carriers in a desired location along the plurality of rails. To facilitate this, the first carrier can define a positioner receiving portion, and the positioner can includes an engagement member for engaging the positioner receiving portion. The engagement member can be displaceable between a first position where the engagement member is engaged with the positioner receiving portion; and a second position where the engagement member is disengaged from the positioner receiving portion. For example, the positioner receiving portion can be defined at least in part by a concavity for receiving the engagement member. If desired, the first carrier can include a marker, and the positioner can further includes a position sensor for selectively locating the first carrier by detecting the marker. The marker can be an optical markers and/or a magnetic marker or a radio frequency identification marker, among others.

In accordance with another aspect of the system herein, a control system can be provided for controlling the system. For example, the control system can include a controller including a processor and memory. In accordance with one aspect, the controller can be operatively associated with the linear actuator and positioner, wherein the controller is programmed to instruct the positioner to selectively position at least one of the first plurality of carriers in a desired location along the plurality of rails. The controller may be programmed to instruct the positioner to position one or more carriers in accordance with a setup configuration. The controller may be a PLC (programmable logic controller) based controller or a PC (personal computer) based controller, among others. The controller can be programmed to compare a quantity of carriers in the system and a quantity of locations to position carriers needed to satisfy the setup configuration, wherein the setup configuration is a predetermined setup configuration stored in the memory. The controller can be further programmed to prompt an operator of the system if more carriers are required to satisfy the setup configuration. If desired, the controller can be further programmed to calculate the storage area and storage locations for carriers not needed to satisfy the setup configuration. Moreover, the controller can be further programmed to minimize the time necessary to execute the setup configuration. For example, the controller can minimize the time necessary to execute the setup configuration at least in part by calculating the minimum number of moves needed to be made by the positioner.

In accordance with a further aspect, the controller may be further programmed to send a series of commands to the linear actuator and positioner to move the carriers to satisfy the setup configuration. The controller may additionally be programmed to send instructions to the positioner to scan the location of each carrier by using a position sensor operatively associated with the positioner. The controller can be further programmed to determine whether each carrier has been positioned within a tolerance range, and optionally to instruct the positioner to perform additional moves to the carriers to achieve the tolerance range required to satisfy the setup configuration.

In accordance with a further aspect of the system, a graphical user interface can be provided. The graphical user interface may be operably coupled to the controller, and adapted and configured for displaying information and for receiving instructions from an operator. The graphical user interface can be adapted and configured to facilitate storage and retrieval of a plurality of setup configurations.

In accordance with still a further aspect, the system can further include an electronically controlled air manifold operably coupled to the controller. The air manifold can be pneumatically coupled to the carriers and adapted and configured to selectively actuate a blade in each carrier from a first retracted position to a second extended position. The controller can also be programmed to actuate one or more blades necessary to perform a desired web slitting operation. If desired, the air manifold can also be pneumatically coupled to a locking bladder. The locking bladder can be changed from an unlocked, uninflated state where it does not contact the carriers, permitting the carriers to move along the rails, to a locked, inflated state, where the carriers are locked in position along the rails. The system can be adapted and configured to verify the position of each blade holder after the bladder has been inflated.

In accordance with still a further aspect, the system can be provided with a second set of rails and carriers. For example, the carriage assembly may further include a second wall disposed proximate the first wall. The second wall may be displaced from the first wall along a direction of travel of the web. A second plurality of rails can be mounted on the second wall extending parallel to the longitudinal axis, and a second plurality of carriers may be disposed on the second plurality of rails. The positioner may be adapted and configured to selectively position each of a first carrier of the first plurality of carriers and a second carrier from the second plurality of carriers in a desired location along the plurality of rails on each wall. The first carrier and second carrier may each define a positioner receiving portion for receiving an engagement member of the positioner. The engagement member may be displaceable along a direction generally parallel or perpendicular to the first and second walls. The controller can be programmed to instruct the positioner to selectively position the first carrier and second carrier along the plurality of rails in accordance with a setup configuration. For example, the controller can be configured to arrange the carriers along the first wall in alignment with carriers displaced along the second wall. If desired, the carriers along the first wall can be out of alignment with carriers displaced along the second wall. Moreover, the carriers in each of the first plurality of carriers and second plurality of carriers can be in mutually supporting intimate contact. A locking bladder can be provided to hold each carrier in the system in position after being positioned by the positioner.

In accordance with a further aspect, the invention provides a machine readable program containing instructions for controlling a system for performing an operation on a web of material. The system can include, for example, a carriage assembly having at least one set of rails, a plurality of carriers disposed on the set of rails, each carrier including a blade or other instrumentality, a linear actuator and positioner for selectively positioning at least one of the carriers along the plurality of rails, and a controller operatively associated with the positioner, the controller including a processor and a memory. The program includes means for instructing the positioner to selectively position at least one of the carriers in a desired location along the plurality of rails.

In accordance with a further aspect, if desired, the program can further include means for instructing the positioner to selectively position at least one of the carriers in a desired location along the rails in accordance with a setup configuration. The program can also include means for comparing the quantity of carriers in the system and the quantity of locations to position carriers needed to satisfy the setup configuration. The setup configuration can be a predetermined setup configuration stored in the memory, or can be input manually by an operator or imported from another source, such as computer readable media, a computer network or wireless connection. The program can also include means for prompting an operator if more carriers are required to satisfy the setup configuration, as well as means for calculating the storage area and storage locations for carriers not needed to satisfy the setup configuration, if desired. The program can optionally include means for substantially minimizing the time necessary to execute the setup configuration, such as by calculating the minimum number of moves needed to satisfy the setup configuration.

In accordance with a further aspect, the computer program includes means for sending a series of commands to the linear actuator and positioner to move the carriers to satisfy the setup configuration. In accordance with one embodiment, the program includes means for sending instructions to the positioner to scan the location of each carrier by using a position sensor operatively associated with the positioner. Moreover, the program can include means for determining whether each carrier has been positioned within a tolerance range, and means for performing additional moves to the carriers to achieve the tolerance range required to satisfy the setup configuration, if desired.

In accordance with still a further aspect, the program may further include means for receiving instructions from an operator entered into a graphical user interface operably coupled to the controller. If desired, the program can further include means for facilitating storage and retrieval of a plurality of setup configurations.

In accordance with yet another aspect, the program can also include means for actuating an electronically controlled air manifold operably coupled to the controller, wherein the air manifold is pneumatically coupled to the carriers. In accordance with this aspect, the program may include means for pneumatically actuating an instrumentality in each carrier, such as a blade, from a first retracted position to a second extended position to perform a desired operation on the web, such as slitting. The program may also include means for verifying that a cut width does not exceed a width of the web of material to be cut, as well as means for verifying that the cut width does not exceed a travel limit of the actuator based upon the position of a first carrier. Means may be provided in the program for instructing the operator to verify the number and range of carriers currently installed.

In accordance with a further aspect, the program can further include means for performing an initial scan to determine the position of each selected carrier prior to moving the carriers with the positioner. Moreover, the program may also include means for checking that the proper number of carriers are installed, means for checking that the carriers that are installed are within predefined limits, and means for checking a store position of each blade. Means can also be provided in the program for applying air to at least one locking bladder to hold one or more carriers in position. The program can further include means to verify the position of each carrier after inflation of the at least one locking bladder.

In further accordance with the invention, a method is provided. The method includes the steps of providing a carriage assembly including at least one wall, a plurality of rails mounted on the wall and a plurality of carriers as embodied herein. Each carrier is capable of supporting an instrumentality for performing an operation on a converting machine. The method further includes the step of providing a positioner operatively coupled to the carriage assembly, and operating the positioner to selectively position at least one of the carriers in a desired location along the plurality of rails.

In accordance with a further aspect, the positioner can be operated to position the at least one of the carriers in a desired location in accordance with a setup configuration as described herein. The positioner can be operated to scan the location of each carrier by using a position sensor operatively associated with the positioner. The method can further include determining whether each carrier has been positioned within a tolerance range. Furthermore, additional moves to one or more of the carriers can be performed with the positioner to achieve the tolerance range required to satisfy the setup configuration. The method can also include, for example, actuating an electronically controlled air manifold operably coupled to the carriers to actuating an instrumentality, such as a blade in each carrier from a first retracted position to a second extended position to perform a desired web slitting operation.

It is to be understood that both the foregoing general description and the following detailed description are exemplary and are intended to provide further explanation of the invention claimed.

The accompanying drawings, which are incorporated in and constitute part of this specification, are included to illustrate and provide a further understanding of the method and system of the invention. Together with the description, the drawings serve to explain the principles of the invention.

BRIEF DESCRIPTION OF THE DRAWINGS

FIGS. 7(*a*) through 7(*f*) are perspective views of the six different knife carriers constructed in accordance with a preferred embodiment of the subject invention; and FIGS. 8(*a*) and 8(*b*) are front plan views of the six knife carriers of the subject invention in an open spaced apart position and in a closed nested position, respectively.

DETAILED DESCRIPTION OF THE PREFERRED EMBODIMENT

Reference will now be made in detail to the present preferred embodiments of the invention, examples of which are illustrated in the accompanying drawings. The method and corresponding steps of the invention will be described in conjunction with the detailed description of the system.

Devices made in accordance with the present invention include, for example, a new and useful automated positioning system for a converting machine, such as a score slitting machine, that is adapted to reduce the setup time needed to position a plurality of instrumentalities, such as knife holders, on a carriage assembly, and a unique carriage assembly that is configured to use, for example, industry standard dovetail mounted pneumatic score knife holders that achieves slit widths as narrow as ½" wide.

Figure 1:
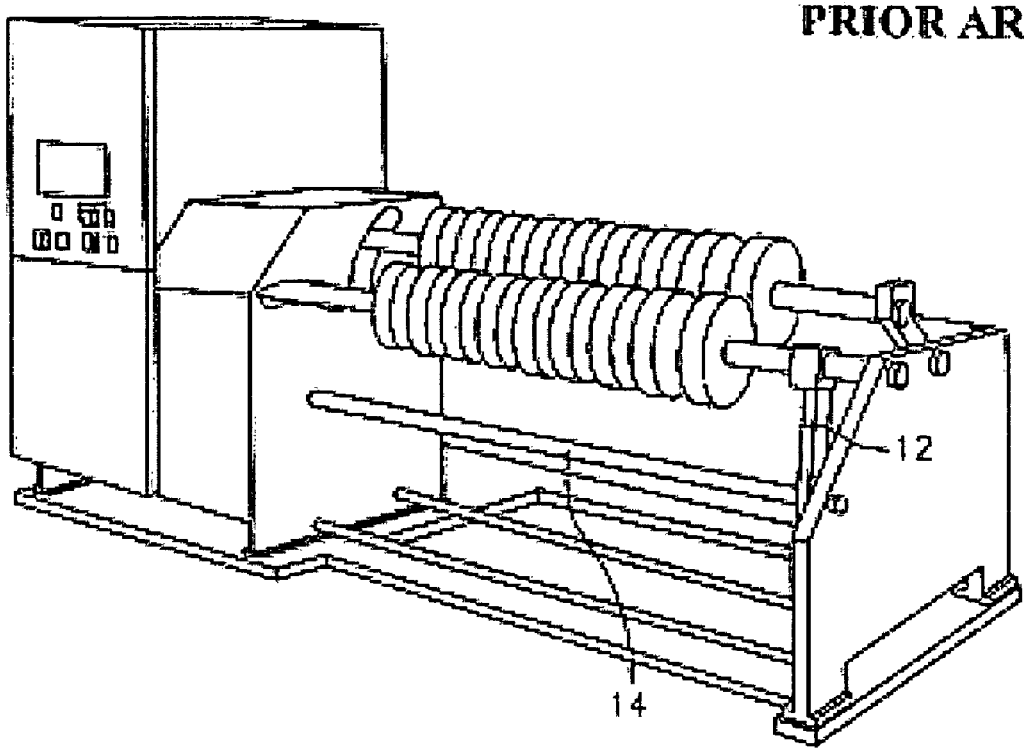
FIG. 1 PRIOR ART
FIG. 1 is a graphical representation of a conventional prior art score-slitting machine.
Figure 2:
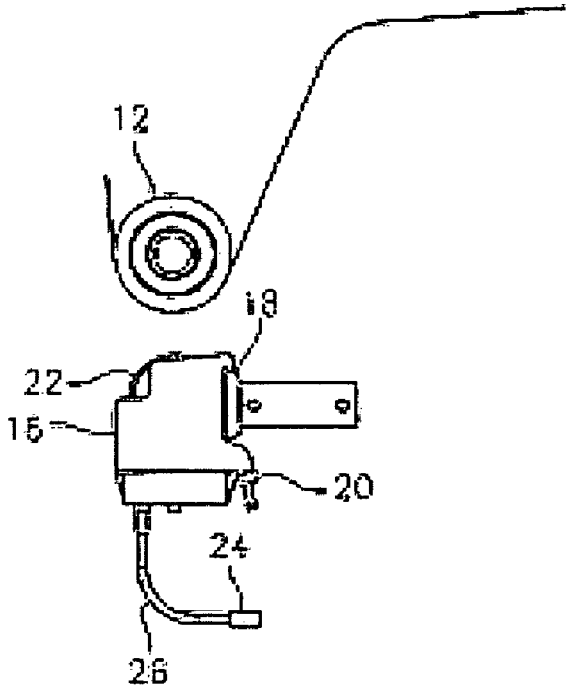
FIG. 2 is a schematic diagram illustrating the manner in which a conventional prior art score slitting machine operates to slit material scoring a scoring knife.
Figure 3:
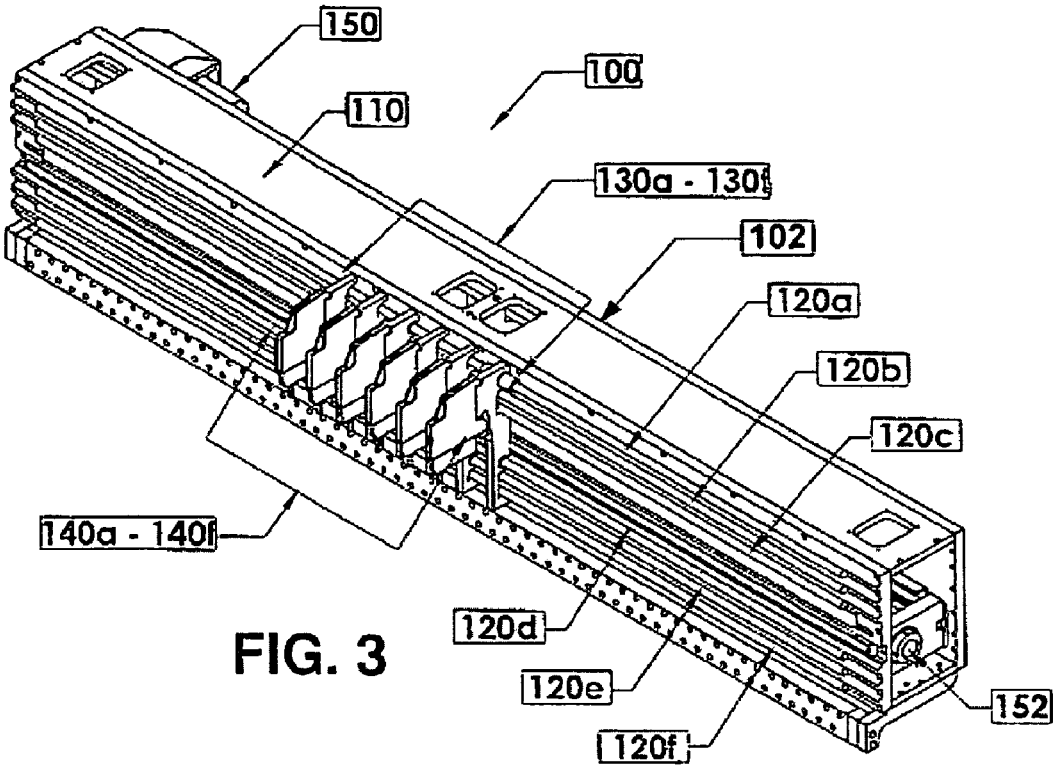
FIG. 3 is a perspective view of a multi-rail carriage assembly for a score slitting machine as shown in FIG. 1, wherein the knife carriers of the subject invention are shown in spaced apart relationship.

For purpose of explanation and illustration, and not limitation, a partial view of an exemplary embodiment of the system in accordance with the invention is shown in FIG. 3 and is designated generally by reference character 100. Other embodiments of a system in accordance with the invention, or aspects thereof, are provided in FIGS. 4-20, as will be described.

Figure 4:
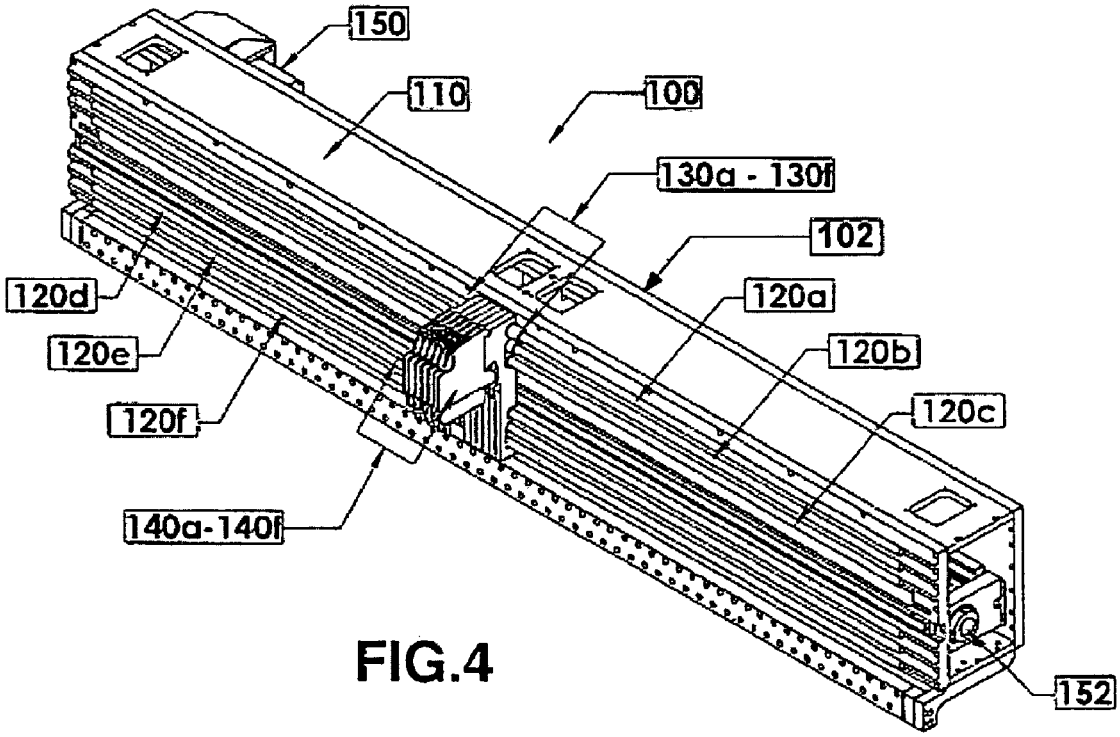
FIG. 4 is a perspective view of a multi-rail carriage assembly for a score slitting machine as shown in FIG. 1, wherein the knife carriers of the subject invention are shown in a closed or nested position in mutually supporting contact.

As depicted in FIGS. 3 and 4, a system 100 including a multi-rail carriage assembly 102 constructed in accordance with a preferred embodiment of the subject invention is provided designated generally by reference numeral 100. Carriage assembly 102 includes an elongated housing 110 having a first wall, 112. The first wall 112 defines a first longitudinal axis, X in a direction of the width of carriage assembly 102. Housing 110 also defines a second axis Y (e.g., a vertical axis) as well as a third axis Z (e.g., in the machine direction in which a web of material travels). Carriage 102 can be disposed in any suitable physical orientation (generally vertical or horizontal or other), as is required by the application. Two sets 116 of linear rails 120 are mounted to the first wall 112 of housing 110. These include an upper set of three parallel rails 120*a*-120*c* and a lower set of three parallel rails 120*d*-120*f*. The plurality of rails 120 extends parallel to the longitudinal axis, X. As depicted in FIGS. 3-4, the six rails 120*a*-120*f* each have a generally circular cross-section. However, the cross-sectional geometry of the rails can differ by choice of design without departing from the spirit or scope of the subject disclosure. For example, rails having ovoid and other types of cross-sections, such as polygonal cross sections, are also possible, some of which are depicted in FIGS. 9-12.

In accordance with a further aspect, the system also includes a first plurality of carriers. Each carrier is adapted and configured to support an instrumentality, such as a knife holder, for performing an operation on a web of material.

For purposes of illustration and not limitation, as depicted in FIGS. 3-4 and 7-8, carriage assembly 102 includes one or more sets of carriers 130*a*-130*f*. The carriers 130*a*-130*f*, which are best illustrated in FIGS. 7*a* through 7*f* and described in greater detail below, are adapted and configured for use in a spaced apart orientation as illustrated in FIGS. 3 and 8*a*, or in intimate contact with one another as illustrated in FIGS. 4 and 8*b* wherein the carriers are in a closed or nested position, depending upon the slitting operation to be performed. In the positions shown in FIGS. 4 and 8*b*, a slit width of ½" can be readily obtained.

As depicted, each carrier 130 includes a carrier body having a first body portion 136 having a first mounting feature 134 and a second body portion 138 having a second mounting feature 134, wherein each mounting feature 134 is configured and adapted to receive one of the plurality of rails 120.

Each carrier 130 can be provided with a plurality of rail positions that can be positioned proximate a mounting rail on a converting machine. For example, the first body 136 portion and second body portion 138 can be provided with a plurality of rail positions 135*a-n*. Each rail position 135*a*-135*n* represents a location or range on carrier body 130 that can be aligned with a rail 120. As depicted in FIG. 7(*a*), each carrier 130 is provided with six rail positions 135*a*-135*f*, wherein each rail position 135 corresponds with the position of a rail 120. Thus, for example, first body portion 136 is provided with rail positions 135*a-c* and second body portion 138 is provided with rail positions 135*d-f*. As depicted, at least one mounting feature 134 is provided proximate a rail position 135 located in the first body portion 136 and in the second body portion 138. For example, mounting features 134 are located at rail positions 135*a* and 135*d* in the carriers 130 depicted in FIGS. 7(*a*) and 7(*f*), at rail positions 135*b* and 135*e* in the carriers depicted in FIGS. 7(*b*) and 7(*e*) and at rail positions 135*c* and 135*f* in the carriers depicted in FIGS. 7(*c*) and 7(*d*). In accordance with an alternate embodiment, carriers 130 can include four rail positions 135*a*-135*d* to either permit passage of rails or to permit attachment of mounting features 134 as depicted in FIGS. 18(*a*)-18(*d*).

Referring now to FIGS. 7(*a*) though 7(*f*), there is illustrated each of the six carriers 130*a*-130*f* of the subject invention. As depicted, each carrier 130*a*-130*f* includes an identical dovetailed mounting flange 132*a*-132*f* formed thereon for supporting an industry standard blade holder 140*a*-140*f*. In addition, each carrier 130*a*-130*f* includes vertically spaced apart mounting features 134 for receiving two of the six rails 120*a*-120*f* of the system 100.

For example, with specific reference to FIG. 7*a*, carrier 130*a* includes a first mounting feature 134 including a mounting sleeve supporting a primary bushing 171 located in the first rail position 135*a* for receiving the first rail 120*a* and a second mounting feature 134 including a mounting sleeve supporting a secondary bushing 172 located in the fourth mounting position (i.e., fourth rail position 135(*d*)) for receiving the fourth rail 120*d*. Similarly, as shown in FIG. 7(*b*), carrier 130*b* includes a first mounting feature 134 in first body portion 136 including a first mounting sleeve supporting a primary bushing 181 mounted therein for receiving the second rail 120*b* and a second mounting feature 134 including a mounting sleeve supporting a secondary bushing 182 disposed therein located in the fifth rail position 135(*e*) for receiving the fifth rail 120*e*. As shown in FIG. 7(*c*), carrier 130*c* includes a first mounting feature 134 including a mounting sleeve supporting a primary bushing 191 located in the third rail position 135(*c*) for receiving the third rail 120*c* and a second mounting feature 134 including a mounting sleeve having a secondary bushing 192 located in the sixth rail position 135*f* for receiving the sixth rail 120*f*.

FIG. 7*d* shows carrier 130*d*, which includes a first mounting feature 134 that includes a mounting sleeve for supporting primary bushing 211 located in the sixth mounting position 135*f* for receiving the sixth rail 120*f* and a second mounting feature 134 including a mounting sleeve for supporting a secondary bushing 212, located in the third rail position 135*c* for receiving the third rail 120*c*. Similarly, as shown in FIG. 7*e*, carrier 130*e* includes a first mounting feature 134 including a mounting sleeve for supporting a primary bushing 221 located in the fifth rail position 135*e* for receiving the fifth rail 120*e* and a second mounting feature 134 including a mounting sleeve for supporting a bushing 222, located in the second rail position 135*b* for receiving the second rail 120*b*. As shown in FIG. 7*f*, carrier 130*f* includes a first mounting feature 134 including a mounting sleeve for supporting a primary bushing 231 located in the fourth rail position 135*d* for receiving the fourth rail 120*d* and a second mounting feature 134 including a mounting sleeve supporting a bushing 232, located in the first rail position 135*a* for receiving the first rail 120*f*.

In accordance with a further aspect, each of the first body portion and second body portion of each carrier can define at least one recess for accommodating at least one rail therethrough. The recess can be located at any rail position where a mounting feature is not present.

For purposes of illustration and not limitation, as depicted in FIG. 7, each carrier 130*a*-130*f* also can include a unique arrangement of recesses or cutouts for accommodating passage of the rails that are not specifically associated therewith (i.e., the rails they are not mounted on), and more specifically the mounting features of adjacent carriers, as will be discussed in greater detail below with respect to FIG. 8*b*.

For example, as shown in FIG. 7*a*, carrier 130*a* includes an upper recess 173 spanning the second and third rail positions 135*b*, 135*c* for accommodating rails 120*b*, 120*c*, as well as the primary bushings 181 and 191 of carriers 130*b* and 130*c*, respectively. Carrier 130*a* further includes a lower recess 174 spanning the fifth and sixth rail positions 135*e*, 135*f* for accommodating rails 120*e* and 120*f* when the carriers are in the nested position shown in FIG. 8*b*.

As shown in FIGS. 7*b*-7*f*, each of the remaining five carriers have a unique arrangement of recesses for accommodating the mounting features 134 of adjacent carriers and rails unassociated therewith. Carriers 130*b* and 130*e* each have four single-rail recesses at the first, third, fourth and sixth rail positions 135*a*, 135*c*, 135*d*, 135*f* for accommodating individual bushings of adjacent carriers, while the other carriers 130*a*, 130*c*, 130*d* and 130*f* each have two dual-rail recesses spanning adjacent rail positions for accommodating two mounting sleeves of adjacent carriers. Those skilled in the art will readily appreciate that the relative positions of carriers 130*a*-130*f* can vary from those shown in FIGS. 8*a* and 8*b*, while still maintaining the desired nested arrangement.

As mentioned above, each carrier disclosed in FIGS. 7-8 is provided with mounting sleeves containing bushings. These bushings, are preferably formed from a metallic material, such as, for example, bronze, and they may be readily removed and replaced if they become worn. Alternatively, the bushings may be formed from a self-lubricating polymeric material, such as Nylon, or a fluoropolymer such as PTFE. In accordance with the embodiment of FIGS. 9-19, mounting features 134 include reciprocating linear ball bearings. As depicted in FIGS. 7-8, the primary mounting sleeve of each carrier 130 projects outwardly from each lateral face of the carrier and has an overall axial length that is equal to about five times the width of the carrier body. In contrast, the secondary mounting apertures are coextensive with the carrier body. The resulting construct is extremely stable.

If desired, the bushings (e.g., 171 . . . ) can be formed integrally with the carrier body. Alternatively, the first bushing can be removably attached to the first body portion by way of one or more threaded fasteners 133, for example, as depicted in FIGS. 18(*a*)-18(*d*).

In accordance with a further aspect, the carriers embodied herein can further include an instrumentality for performing an operation on a web of material. In accordance with one embodiment, the instrumentality is a blade.

Figure 5:
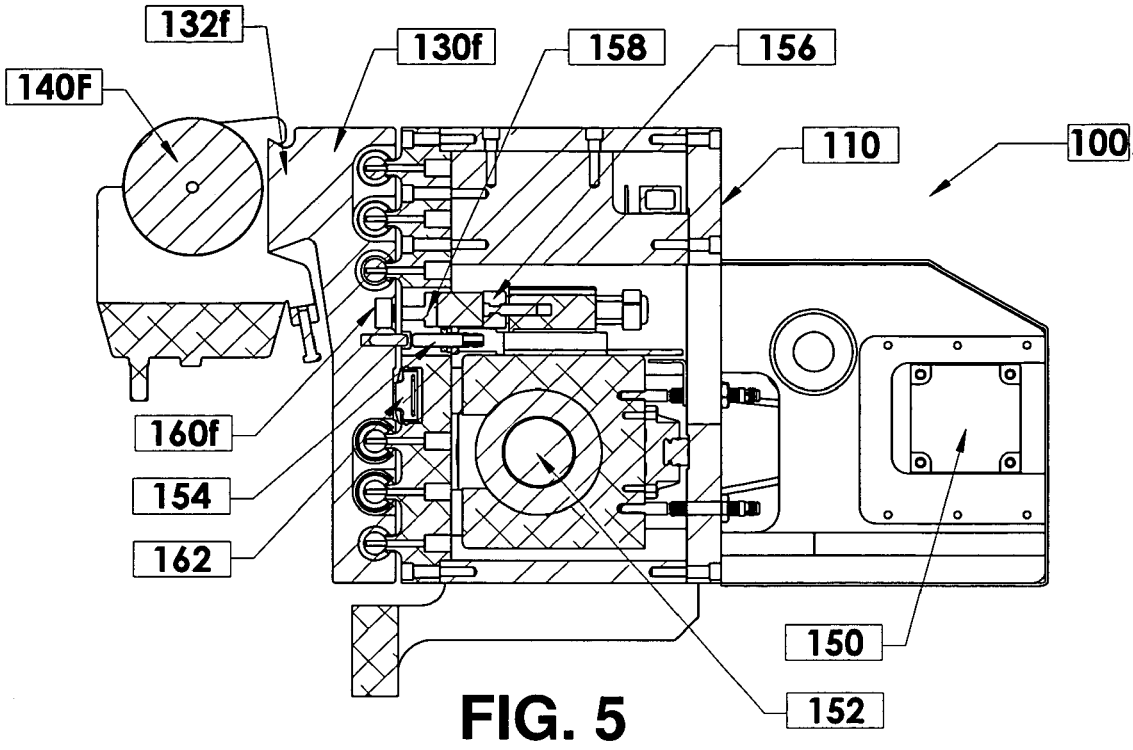
FIG. 5 is a cross-sectional view of the multi-rail carriage assembly of the subject invention, with the carriage positioning mechanism disposed in a disengaged position.

For purposes of illustration and not limitation, as depicted in FIGS. 3-6, for example, a plurality of blade holders 140*a*-140*f* are provided, wherein each blade holder 140 includes a blade 145. In accordance with a preferred embodiment, as depicted in FIGS. 3-6, blade holders 140 are industry standard pneumatically actuated dovetail mounting blade holders 140*a*-140*f*. As depicted in FIG. 5, each blade holder 140 includes a generally rectangular housing 142 having a mounting portion 144 for receiving a dovetail mounting flange 132, as well as an air inlet 146 for receiving a pneumatic actuator line 148 that is operably coupled to an air manifold, discussed in detail below.

Blade 145 can be chosen, for example, from the group consisting of razor blades, shear slitting blades and score slitting blades. In addition, blade holder 140 and carrier 130 may be provided as separate members, or may be integrally formed and constitute a single part. Moreover, flange 132 can be mounted in a variety of locations on the carrier. While the carriers depicted in FIGS. 3-6 depict flange 132 disposed on first body portion 136, flange 132 can alternatively be mounted on second body portion 138. By way of further example, the flange 132 can be disposed on medial body portion 139 of each carrier disposed between the first body portion 136 and the second body portion 138.

Moreover, those skilled in the art should recognize that the system disclosed herein is not limited to score slitting applications and machines. For example, the subject system can be applied to any suitable converting machine application where a web of material is involved and a plurality of instrumentalities are needed to perform an operation on the web, such as in printing operations, lamination and sealing operations (such as in forming pouches or inflatable packaging material), thermal bonding and coating applications, and the like.

In accordance with a further aspect of the system, a linear actuator and positioner operatively associated with the elongate housing can be provided.

Figure 6:
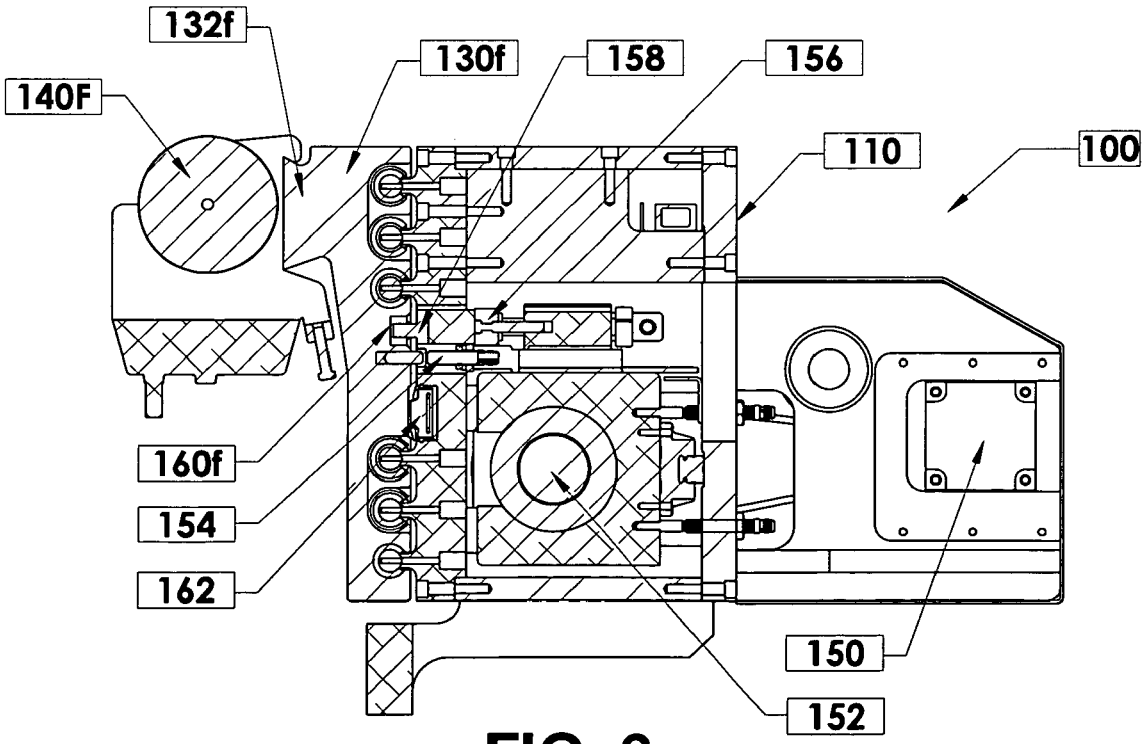
FIG. 6 is a cross-sectional view of the multi-rail carriage assembly of the subject invention, with the carriage positioning mechanism disposed in an engaged position.
Figure 19A:
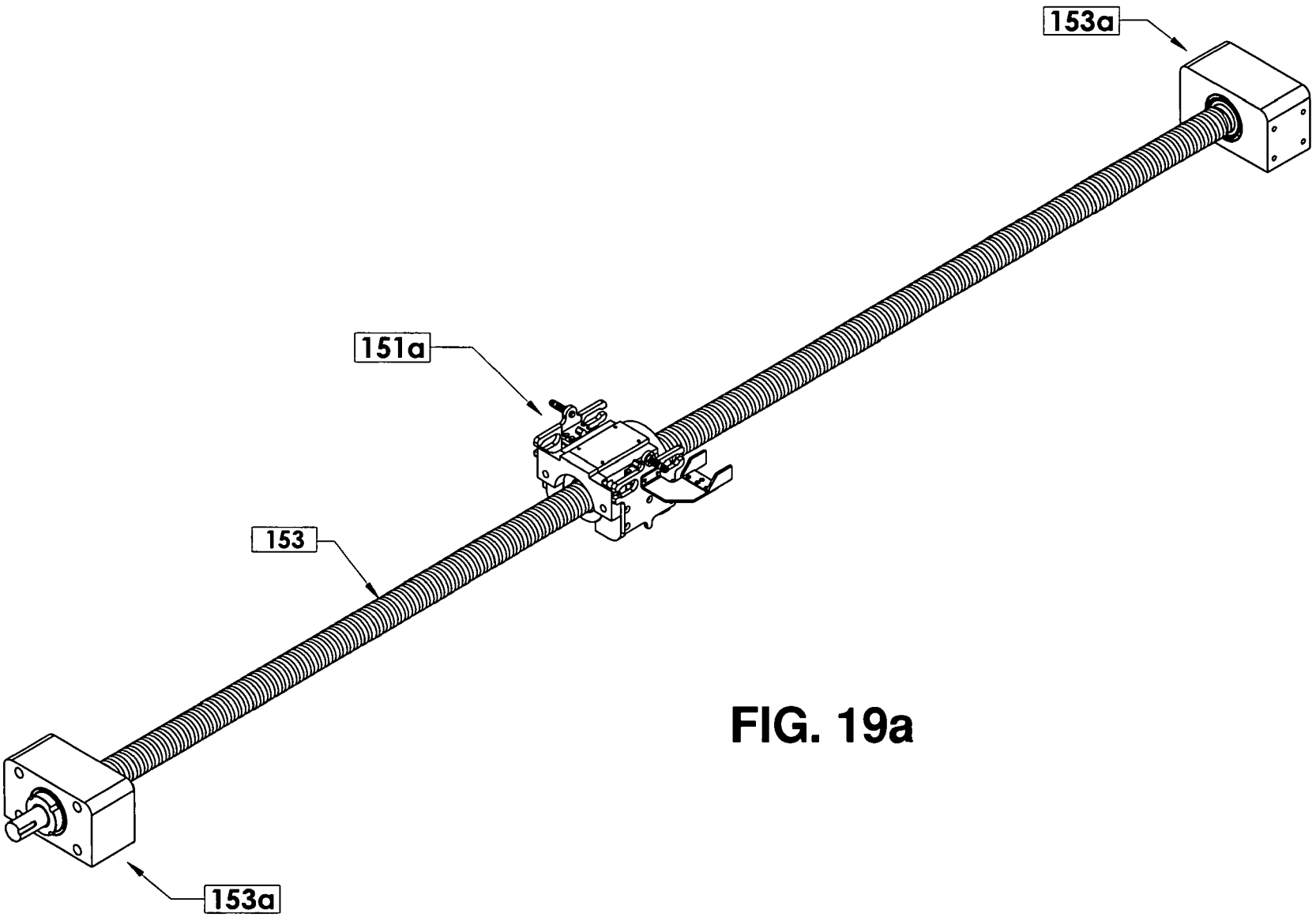
FIGS. 19(*a*)-19(*b*) are assembled and exploded isometric views of a portion of the positioner assembly of FIG. 9.
Figure 19B:
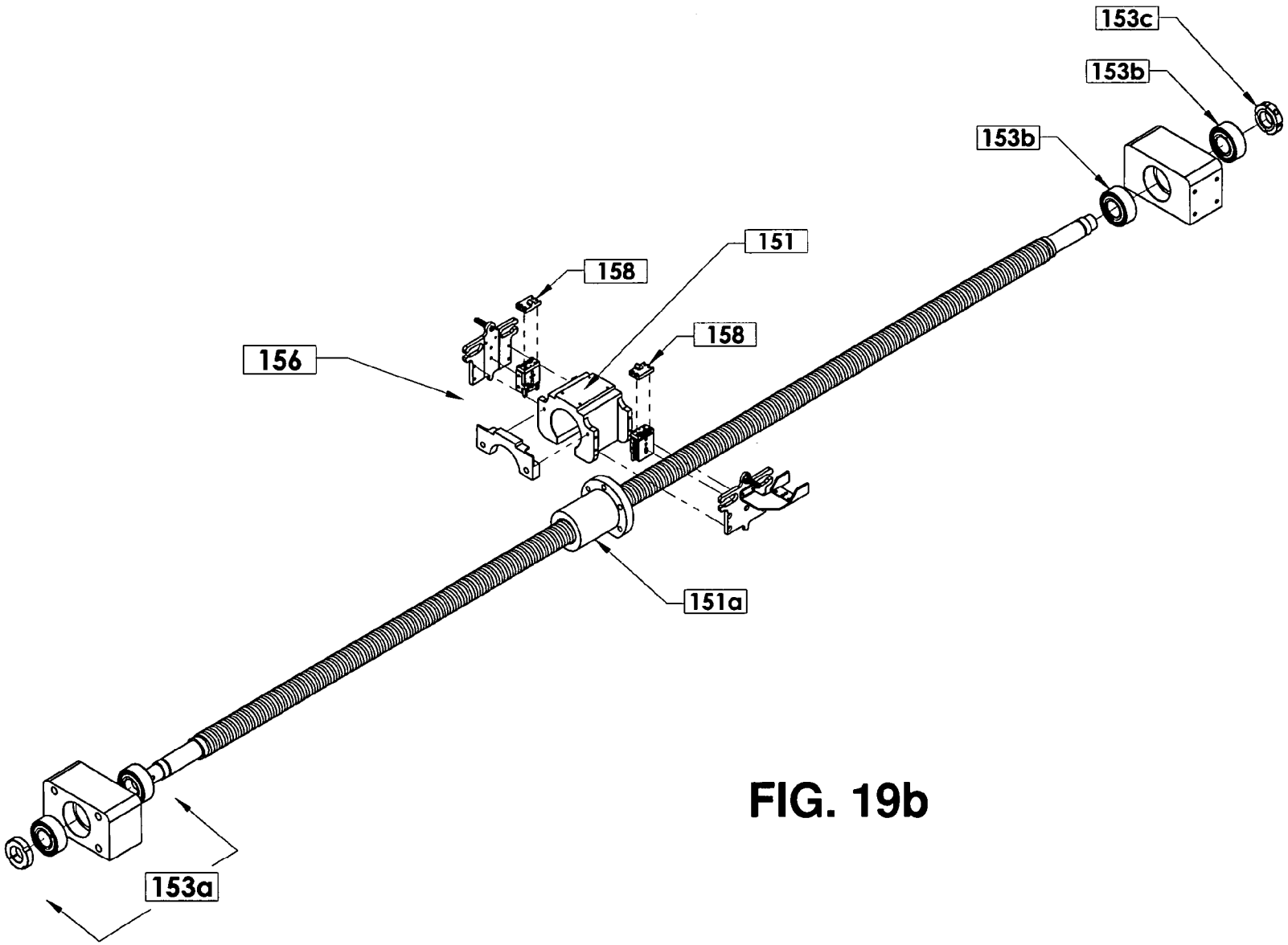

For purposes of illustration and not limitation, as depicted in FIGS. 5 and 6, carriage assembly 102 further includes a linear actuator 152 including a servo motor 150, which is operatively associated with housing 110. Linear actuator 152 is adapted and configured to selectively position each of the carriers 130*a*-130*f* in a desired location using positioner 156 along the rails 120*a*-120*f*, either manually, or in accordance with a predefined set up routine, as instructed by a control system 300 described in more detail below. As depicted, linear actuator 152 is mounted for linear movement along on an axis X disposed within housing 110 using a drive 157. As depicted in FIGS. 19(*a*)-19(*b*), linear actuator 152 can include a power screw 153 rotatably mounted in a plurality of support blocks 153*a* including supportive ball bearings 153*b* and retainers 153*c* operably coupled to a motor 157, wherein positioner 156, including body 151 rides along power screw 153 via a threaded collar 151*a*. Alternatively, drive 157 can take other forms, such as a hydraulic or pneumatic cylinder to displace body 151 along axis X, if desired.

As depicted in FIGS. 5 and 6, for example, a position sensor 154 can be provided that is operatively associated with positioner 156 for selectively locating the carriers 130*a*-130*f* along the rails 120*a*-120*f*. To facilitate this, each carrier 130*a*-130*f* can be provided with an identifiable marker 155*a*-155*f* (see FIGS. 7*a*-7*f*) that can be readily detected by the position sensor 154 through reflectance or a similar modality. The marker can be an optical markers and/or a magnetic marker or a radio frequency identification marker, among others, including mechanical limit switches, for example. Still other sensing means can be employed to determine the position of the carriers along the rails 120, such as for example magnetic position sensors, without departing from the spirit or scope of he subject disclosure. As such, position sensor 154 is configured and adapted to detect the position of each carrier by way of position sensor 155.

With continuing reference to FIGS. 5 and 6, positioner 156 including body 151 is operatively associated with linear actuator 152 and position sensor 154, for selectively engaging carriers 130*a*-130*f*, as instructed by the control system 300. The positioner 156 is adapted and configured to displace an engagement member 158 in a direction perpendicular to the axis X of the rails 120 to engage a carrier 130 by moving between a retracted or disengaged position shown in FIG. 5 and an extended or engaged position shown in FIG. 6. When extended and engaged, engagement member 158, such as a spherical ball, seats in positioner receiving portions 160*a*-160*f* depicted as concavities formed in the rear surfaces of carriers 130*a*-130*f*.

For example, in the retracted or disengaged position of FIG. 5, the engagement member 158 of positioner 156 is spaced from concavity 160*f* formed in the rear surface of carrier 130*f*. In the extended or engaged position of FIG. 6, the engagement member 158 of positioner 156 is seated in the concavity 160*f* of carrier 130*f*. Once seated, when the positioner 156 is displaced along the direction of rails 120, as instructed by the control system 300, the carrier 130*f* will be moved therewith along rails 120*a* and 120*d* to a desired position on the carriage assembly 102. Once in the desired position, the positioner 156 will retract the engagement member 158 from the concavity 160*f* and the positioner 156 will proceed to another location, as instructed by the control system 300, discussed in detail below.

A variety of engagement members 158 can be used. While a mechanical system has been depicted, other systems, such as a system using electromagnets to selectively engage each carrier 130 are well within the scope of the disclosure.

In accordance with still a further aspect, the system 100 can further include an electronically controlled air manifold 320 operably coupled to the controller 330, discussed below. The air manifold can be pneumatically coupled to the knife holders 140 mounted on carriers 130 and be adapted and configured to selectively actuate blade 145 on each carrier 130 from a first retracted position to a second extended position. The controller 330 can also be programmed to actuate one or more blades necessary to perform a desired web slitting operation. If desired, the air manifold 320 can also be pneumatically coupled to a locking bladder 162 as depicted in FIGS. 5-6, for example. The locking bladder 162 can be changed from an unlocked, uninflated state where it does not contact the carriers 130, permitting the carriers 130 to be moved along the rails 120 by positioner 156, to a locked, inflated state, where the carriers 130 are locked in position on the rails 120 to perform an operation on a web of material. The positioner 156 can be adapted and configured to verify the position of each carrier 130 after the bladder 162 has been inflated to verify that bladder inflation or other movement has not altered the setup configuration.

In accordance with another aspect of the system herein, a control system can be provided for controlling the system in a partial or fully automatic manner.

Figure 20:
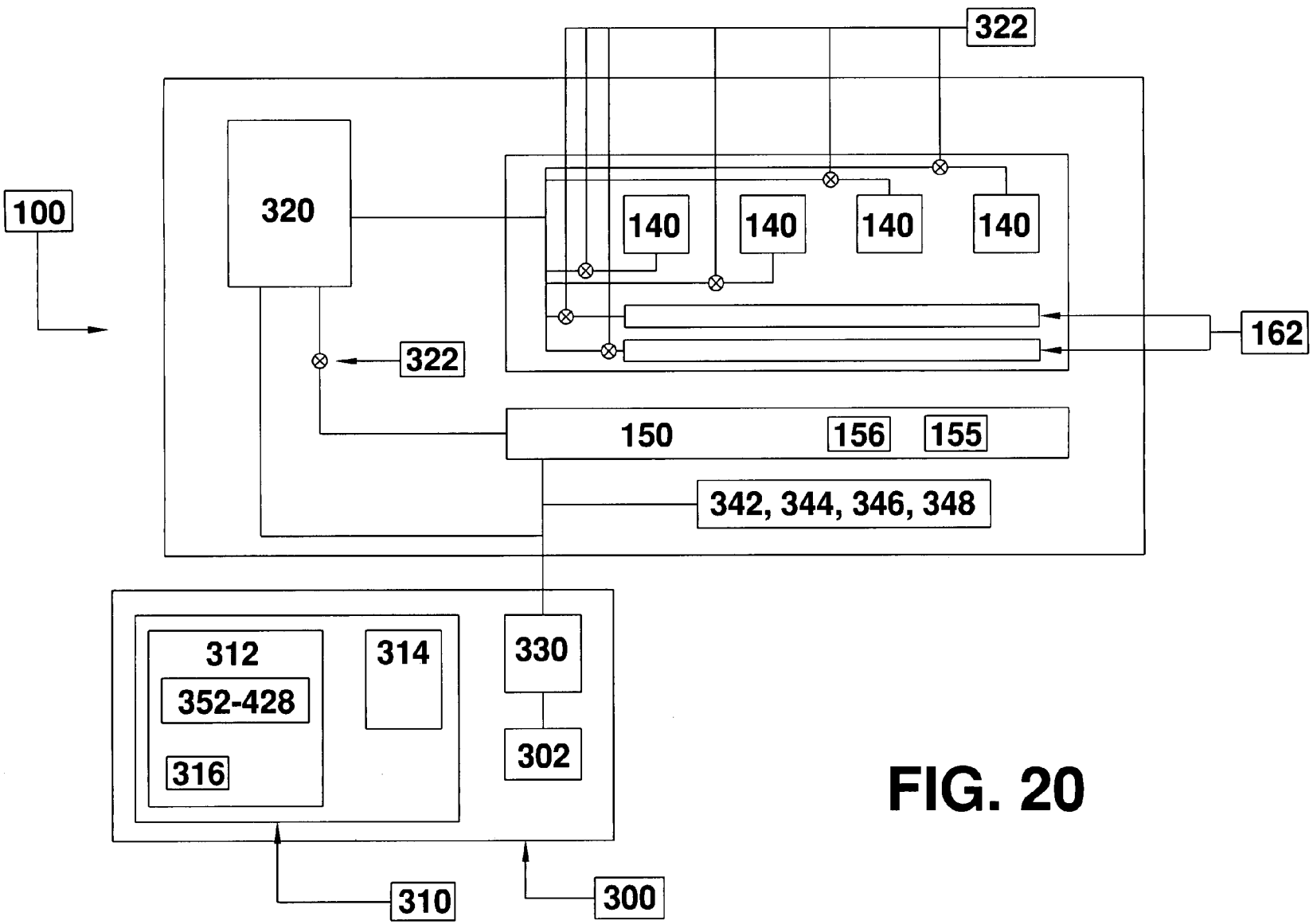
FIG. 20 is a schematic representation of an exemplary embodiment of a system made in accordance with the present invention illustrating the control and pneumatic systems of the system.

For purposes of illustration and not limitation, as depicted in FIG. 20, control system 300 is operably coupled to the positioner (e.g., 156 herein) to create a fully or semi-automated positioning system. The control system 300 includes a machine readable program that is adapted to be read by a controller 330 in order to operate various portions of system 100 in accordance with the methods of operation embodied herein. The computer program may be embodied either in software or in hardware, such as a memory chip. The computer program may be written using well known techniques as are well known in the art. The computer program in accordance with the invention has instructions therein for operating the system 100. Preferably, the instructions in machine readable format will be contained on a computer chip or other memory device 302 in the system 100 for controller 330 to access when system 100 is operated by an operator via interface 310. Thus, when an operator presses a button on interface 310 to initiate a setup routine, for example, the computer chip 302 containing the instructions in machine readable format will be accessed by the controller 330 to operate the system 100. However, the computer program may also be embodied in a software program and run from a computer located inside or outside of the device.

Via machine readable program, control system 300 can be adapted and configured to selectively position the carriers 130*a*-130*f* along the rails 120 of carriage assembly 102 by using positioner 156 including linear actuator 152 as described herein. Control system 300 can be further configured via machine readable program to scan the locations of carriers 130 using position sensor 154 of positioner 156 to determine the accuracy of the set up relative to a desired arrangement. The arrangement can be predefined in system memory 302, or may be input by an operator arrangement through graphical user interface 310, discussed below or other means, such as RF connection or computer network 304. The control system 300 of system 100 can be programmed to automatically reposition any carrier 130 that is not within the tolerances of the predefined arrangement before completing the setup.

As embodied herein in FIG. 20, the system also employs a graphical user interface 310 that is easy to operate and facilitates the ready storage and retrieval of a multitude of predefined knife holder arrangements. In use, an operator can optionally initially enter a number of variables such as the web width, number of cuts to be performed in the case of a slitting operation, the distance to the first knife, left trim and right trim into appropriate fields in the graphical user interface by way of a touch screen 312 or keypad 314, for example. The operator is then prompted by system 100 to enter the cut widths. In certain instances, the cut width fields 316 will be automatically populated after the operator enters a single cut width. All cuts are then displayed, and the operator may adjust each or any one on an individual basis. The operator must then verify the entered variables. The graphical user interface 310 can be adapted and configured to facilitate storage and retrieval of a plurality of setup configurations.

In accordance with one aspect, an operator can enter groups of cuts of different widths. For example, an operator can input a first group of cuts 1.0 inches wide, and a second group of cuts 1.25 inches wide. Any suitable number of groups can be entered requesting any number of cuts of a desired width.

The control system 300 then verifies that all cut widths do not exceed the web width of the media and that the cut width does not exceed the travel limit of positioner 156 based upon the first knife position. The program then responds by instructing the operator to verify the number and range of knives currently installed. Air is then applied via air manifold 320 to the employed knife holders 140 and locking pneumatic bladder 162 by way of individual controllable solenoid valves 322, and the control system 300 performs an initial knife position scan. During this scan, the control system 300 checks that the proper number of knives are installed, that the knives that are installed are within predefined limits, and the store position of each knife.

The control system 300 herein can use a PLC or PC based controller 330 to perform operational tasks, including, but not limited to the following tasks: a) run a series of algorithms designed to compare the actual carrier 130 quantity and locations to the desired setup conditions stored in memory; b) prompt the operator if more carriers 130 (e.g., with blades 145) are required for the setup; c) calculate the storage area and storage locations for unused carriers 130; d) calculate the number of moves and most efficient method for positioning the carriers 130; e) send a series of commands to the servo-driven actuator to perform the moves; f) analyze the carrier and blade locations of the performed setup and compare that to predefined tolerance range; g) perform additional moves to achieve the tolerance range required and/or complete the setup routine. Controller 330 is operably coupled to the various parts of system 100, including, for example, linear actuator 152, air manifold 320 and graphical user interface 310.

Moreover, the controller 330 can be further programmed to minimize the time necessary to execute the setup configuration. For example, the controller 330 can minimize the time necessary to execute the setup configuration at least in part by calculating the minimum number of moves needed to be made by the positioner.

In accordance with a further aspect, the controller 330 may be further programmed to send a series of commands to the linear actuator 152 and positioner 156 to cause the positioner 156 to move the carriers 130 to satisfy the setup configuration. The controller 330 may additionally be programmed to send instructions to the linear actuator 152 and positioner 156 to scan the location of each carrier 130 by using a position sensor operatively associated with the positioner, as indicated in the below list. The controller 330 can be further programmed to determine whether each carrier 130 has been positioned within a tolerance range, and optionally to instruct the positioner 156 to perform additional moves to the carriers 130 to achieve the tolerance range required to satisfy the setup configuration.

In further accordance with the control system and machine readable program of the invention, a variety of system variables can be measured, detected and/or displayed on screen 312 and utilized by the controller 330 to perform the various tasks described above. These variables can include, for example:

1. Actuator Width 352: This represents the useable distance of travel of linear actuator 152 that can be used to position carriers 130 (i.e., home to end limit)
2. Positioner Home Speed 354: This represents the speed at which the positioner 156 moves to return to the home position. The home position can be any pre-programmed position along the distance of travel of positioner. For example, positioner 156 may keep linear actuator 152 in a home position at either extremity of its range of motion, or in the middle of its range of motion, depending on the setup configuration
3. Positioner Position Speed 356: This is the speed at which the positioner 156 is programmed to be moved by linear actuator 152 to move a carrier 130 from a first position to a second position.
4. Positioner Rapid Speed 358: This is the highest speed at which the positioner 156 moves when not engaged with a carrier 130.
5. Knife Scan Speed 360: This is the speed at which the positioner 156 moves to scan and verify the position of each carrier 130.

6. Knife Holder Offset 362: This is the lateral distance along axis X between the position sensor 155 and blade 145 to facilitate precise placement of blade 145 along rails 120.
7. Knife Holder Width 364: This is the width of knife holder 140.
8. Distance To Home 366: This is the point of reference by which an operator may ordinarily measure from. In accordance with one embodiment, this is the distance from home position to inside of machine frame.
9. Number of Solenoids 368: This is the total number of pneumatic solenoids in system 100 for actuating knife holders 140 as well as locking bladder or bladders 162.
10. Ability to check sensors: By detecting the presence of each of these sensors, controller 330 is able to more efficiently operate system 100.
    a. Home sensor 342: The home sensor can be located at either end of the linear actuator 152.
    b. Far limit sensor 344: A far limit sensor can be located at the extremity of travel of linear actuator 152 at a distance farthest displaced from the home sensor, for example.
    c. Near limit sensor 346: This can be located at extremity of travel of linear actuator 152 near the home sensor.
    d. Knife position sensor 155.
    e. Actuator de-activated sensor 348: This sensor indicates that the knife holder positioning grouper is in an unactuated state.

By way of further example, the following list of variables may be displayed and/or selected by the operator by way of a series of prompts or data entry fields contained in the graphical user interface.

1. Web Width 370: Total width of web material.
2. Number Of Slits 372: Total number of rolls to be slit from web of material.
3. Centered Mode 374: Center knife setup or use operator entered first knife. This places all knife holders in a position based on the center line of the machine. This can also be referred to as "centered mode."
4. Left Trim Width 376: Width of left side trim.
5. Right Trim Width 378: Width of right side trim.
6. Left Trim Present 380: Trim cut on left side is present.
7. Right Trim Present 382: Trim cut on right side present.
8. Unit of Measurement 384: In accordance with one embodiment, entering "True" will result in metric measurement (e.g., millimeters), and entering "False" will result in English (e.g., inches).
9. First Knife Position 386: This represents the position of the first knife from edge of housing 110 (in the case of the master knife setup).
10. Knife Scan Initiate 388: Selecting this option initiates a scan of the positions of carriers 130.
11. Positioning Tolerance 390: This represents the tolerance of positioned carriers 130. This can be checked after all carriers 130 have been positioned.
12. Positioner Home 392: Selecting this option initiates a routine to return positioner to its home position.
13. Program Stop 394: Selecting this option immediately stops the positioning program.
14. Verify Cut Widths 396: The system 100 can prompt the operator to verify the accuracy of the inputted setup configuration.

By way of further example, the graphical user interface 310 can also be configured to display the following informational items relative to a particular knife setup or job recipe.

1. Percent Complete 398: This item represents the percent to which the knife setup routine has been completed.
2. Elapsed Setup Time 400: This item represents the total time elapsed for knife setup.
3. Current Position 402: This item represents the current location of positioner 156 along linear actuator 152.
4. Number Knives Required 404: This item represents the number of knives required for a desired setup routine.
5. Knife Range 406: This item represents the high and low number for knife range required for setup configuration.
6. Active Knife 408: This item indicates the current knife being positioned by positioner 156.
7. Active Knife Target 410: This item represents the target location for the active carrier 130 in the setup routine.
8. Program Running 412: This item indicates that the positioning routine is active and ongoing.
9. Program Ready 414: This indication represents that all systems are active, homed and ready.
10. Program Complete 416: This indication represents when positioning program has completed
11. Knife Scan Active 418: This item indicates that the positioner 156 is verifying the position of each carrier 130 to ensure that it falls within the tolerance of the setup routine.
12. Knife Scan Complete 420: This item indicates that the scan routine to ascertain the position of each carrier 130 has been completed.
13. Servo Ready 422: This indicates that the servo is active, with no faults. Power is applied to the servo and the self checks have passed.
14. Servo Fault 424: Servo faulted. This indicates that a fault has occurred which could keep the servo from functioning properly.
15. Servo Home Active 426: Servo performing home routine. Following power up, the servo must home to establish a zero position. Home active indicates that actuator is in process of locating the home sensor.
16. Servo Home Complete 428: Servo has been homed. This indicates that the servo has been homed and has successfully zeroed at the home sensor In accordance with still a further aspect, the system can be provided with a second set of rails and carriers.

For purposes of further illustration and not limitation, as depicted in FIGS. 9-19, another embodiment of a device 100 made in accordance with the teachings of the invention is depicted. This embodiment is similar to the embodiment of FIGS. 3-8. However, instead of only having a single-sided carriage 102 with a set of rails for supporting a plurality of carriers, the embodiment of FIGS. 9(*a*)-9(*b*) includes a dual-sided carriage 200 capable of biasing two rows of instrumentalities, such as knives 145, against sleeve roll 12. As depicted, carriage 200 includes a first side or first wall 202 and a second side or second wall 204 disposed proximate the first wall 202. As embodied herein, the second wall 204 is displaced from the first wall 202 along a direction of travel of the web Z. Each of sides 202, 204 support a first plurality of rails 120 and a second plurality of rails 220 extending parallel to the longitudinal axis X. As depicted, each side 202, 204 includes upper rails 120*a*, 120*b* and lower rails 120*d* and 120*e*. However, any suitable number of rails 120 can be employed in accordance with the teachings herein.

Figure 12:
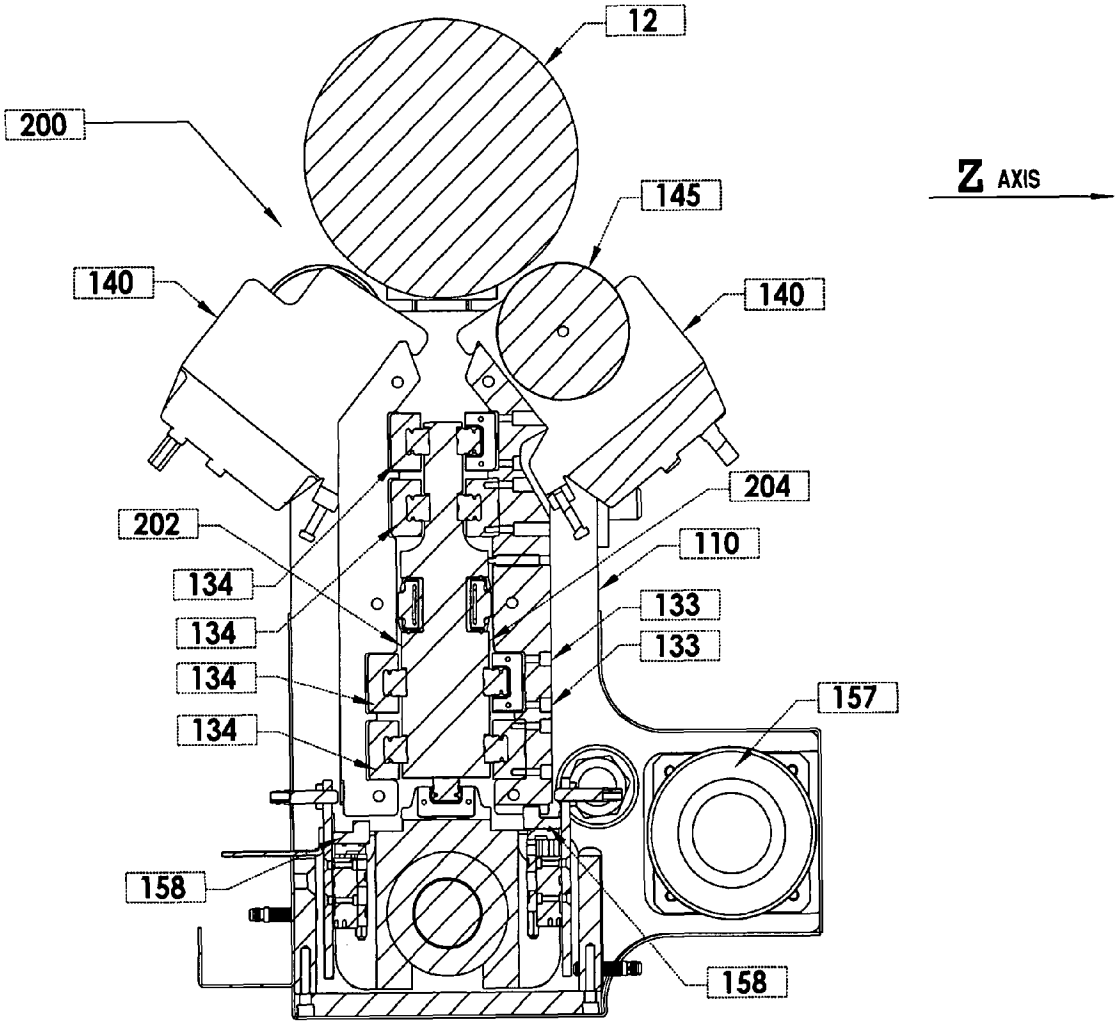
FIG. 12 is a schematic view of the embodiment of FIG. 9 with a first bank of carriers disengaged from the positioner and a second bank of carriers engaged with the positioner.
Figure 13:
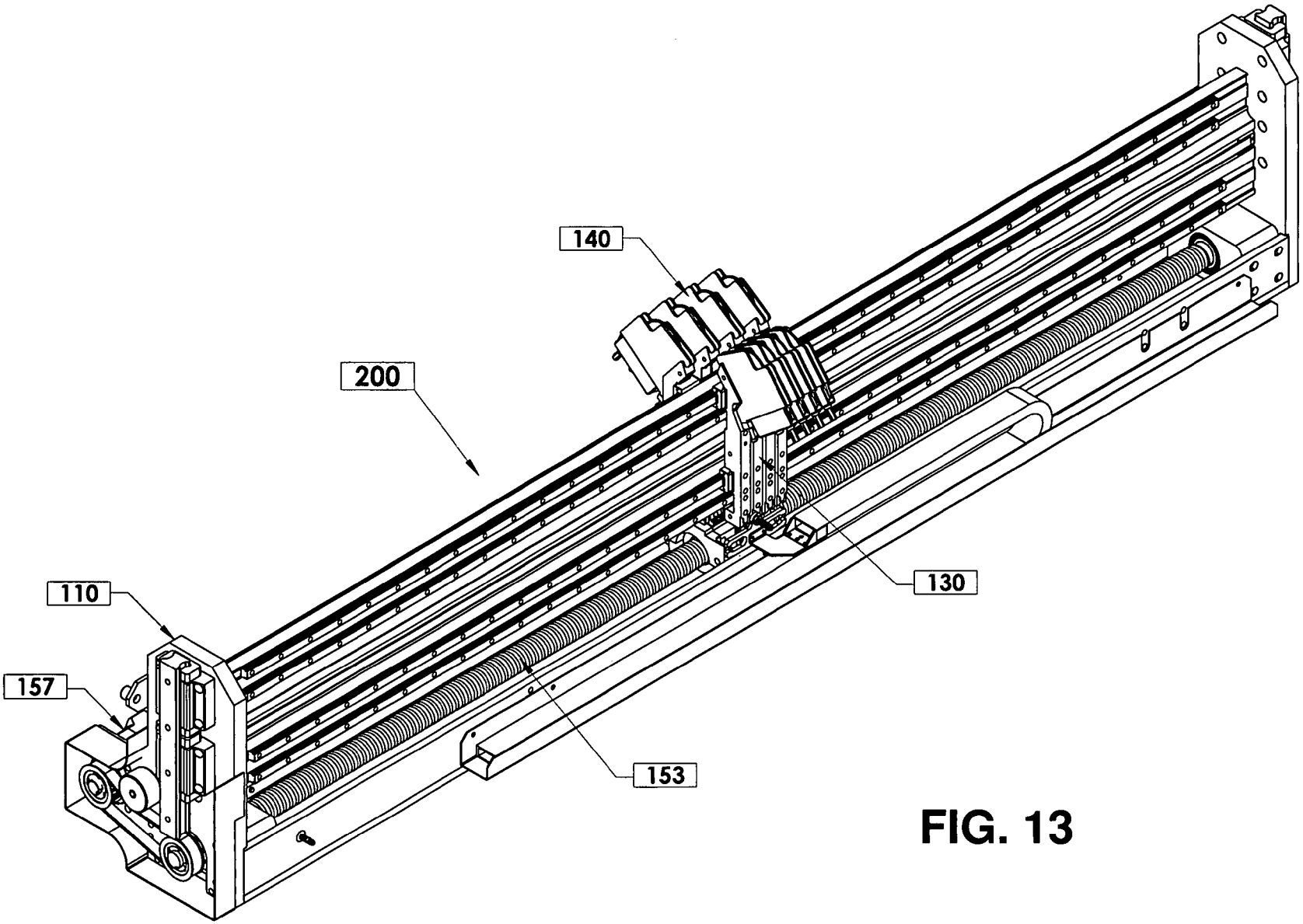
FIG. 13 is an isometric view of the carrier of FIG. 9.
Figure 14:
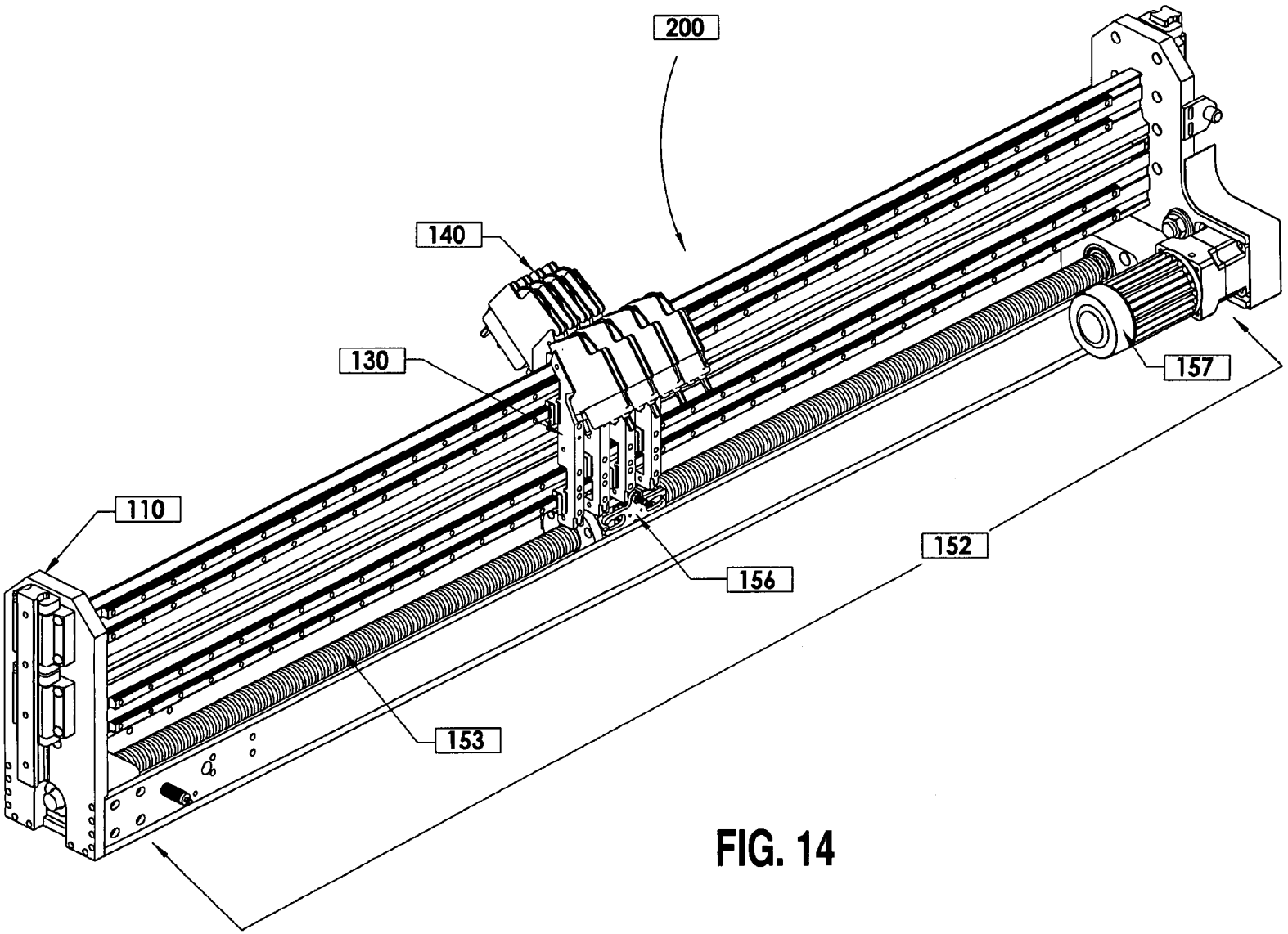
FIG. 14 is an isometric view of the carrier of FIG. 9 showing a view of the opposite side of the carriage from FIG. 13.
Figure 15A:
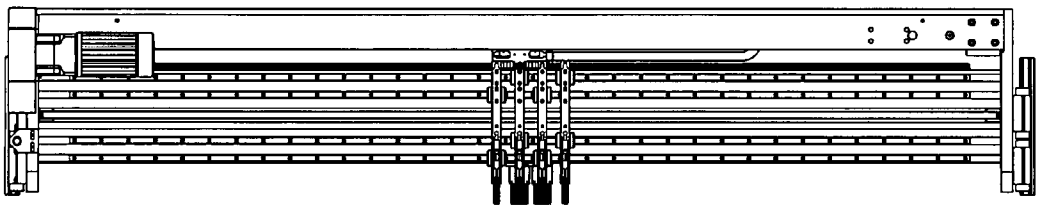
FIGS. 15(*a*)-15(*f*) are a left side plan view, a top plan view, a right side plan view, a bottom plan view, a drive end plan view and an idle end plan view of the embodiment of FIG. 9, respectively.
Figure 15B:
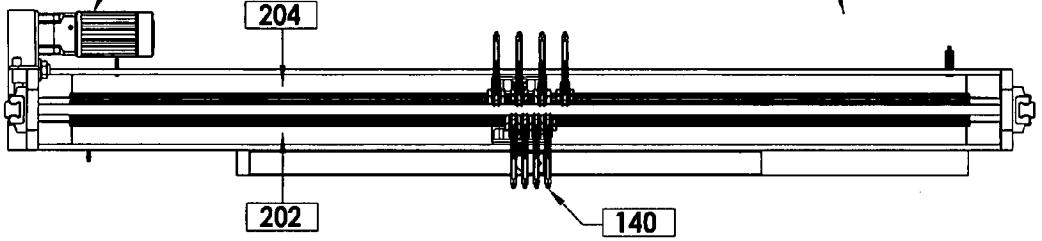
Figure 15C:
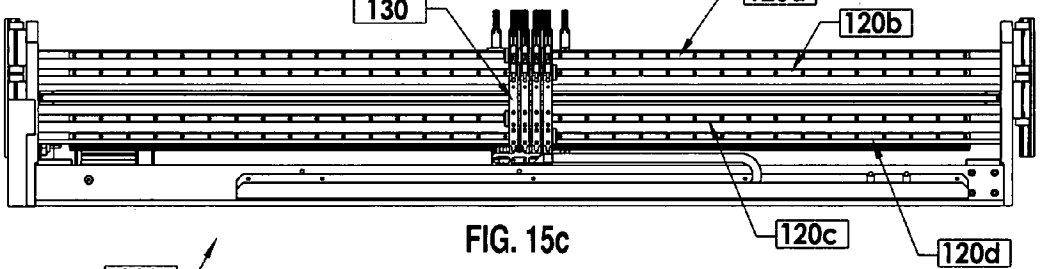
Figure 15D:
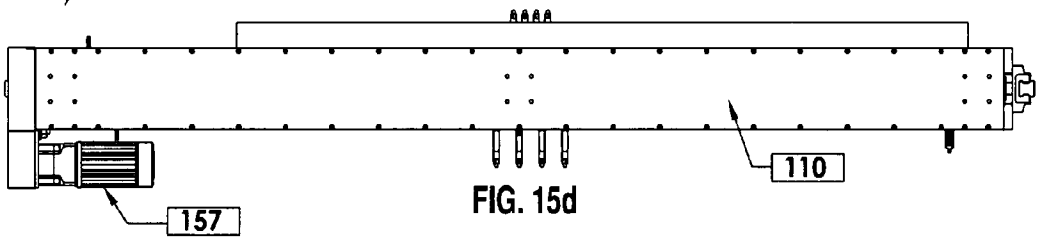
Figure 15E:
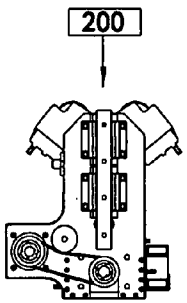
Figure 15F:
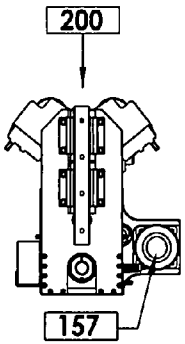

FIG. 13 depicts an isometric view of carriage assembly 200 from one view, while FIG. 14 depicts an isometric view of carriage assembly mirrored about the center axis to view the side including the drive system 157. FIGS. 15(*a*)-15(*f*) are a left side plan view, a top plan view, a right side plan view, a bottom plan view, a drive end plan view and an idle end plan view of the embodiment of FIGS. 9-14, respectively.

Figure 9B:
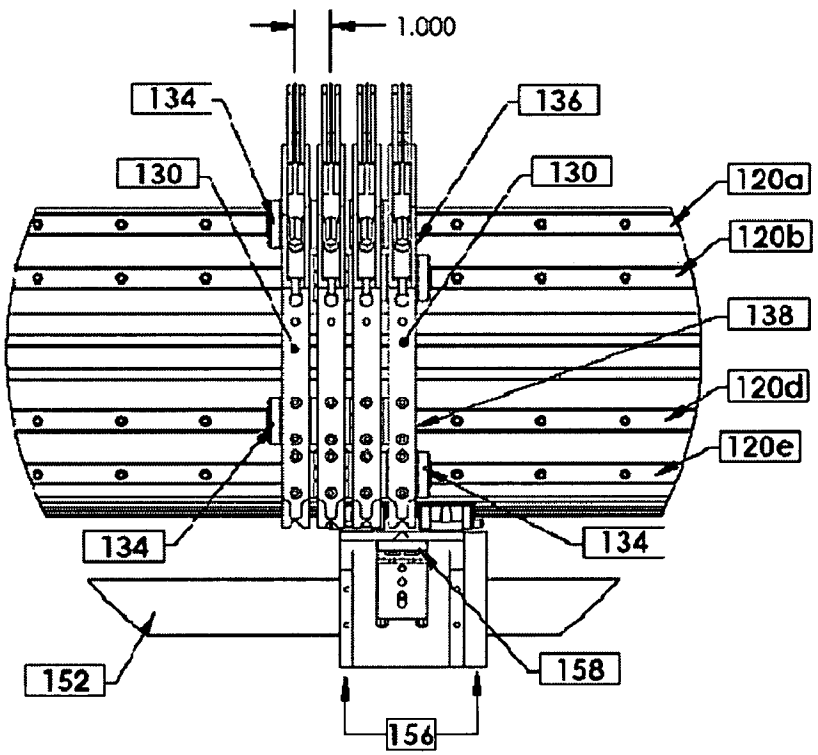
FIGS. 9(*a*) and 9(*b*) are partial side and front views of a second embodiment of a device made in accordance with the present invention.
Figure 9A:
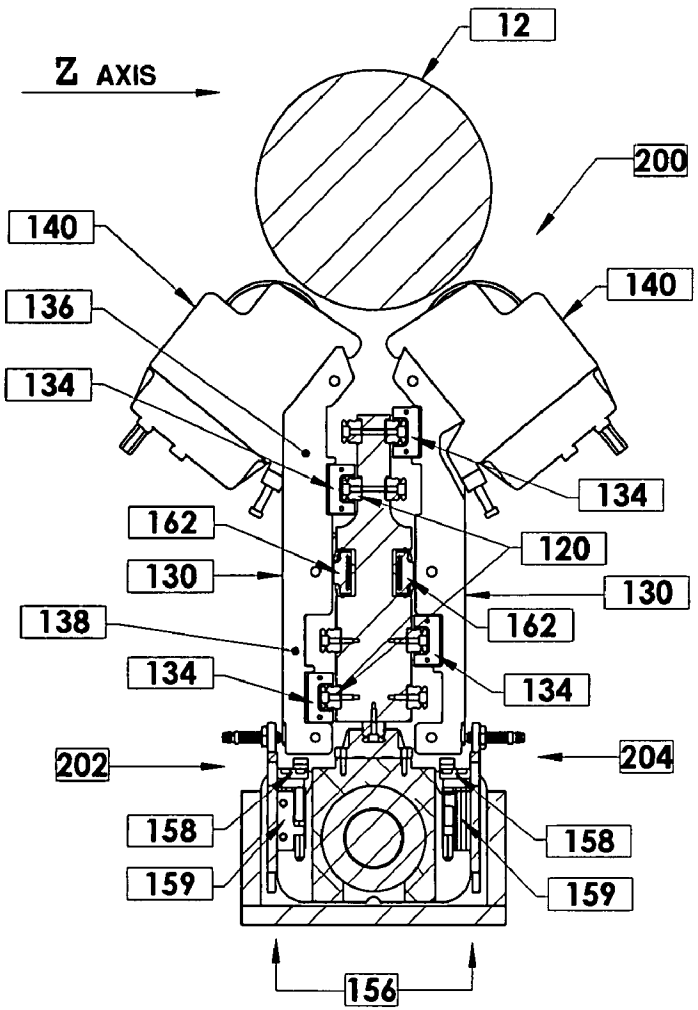
Figure 16:
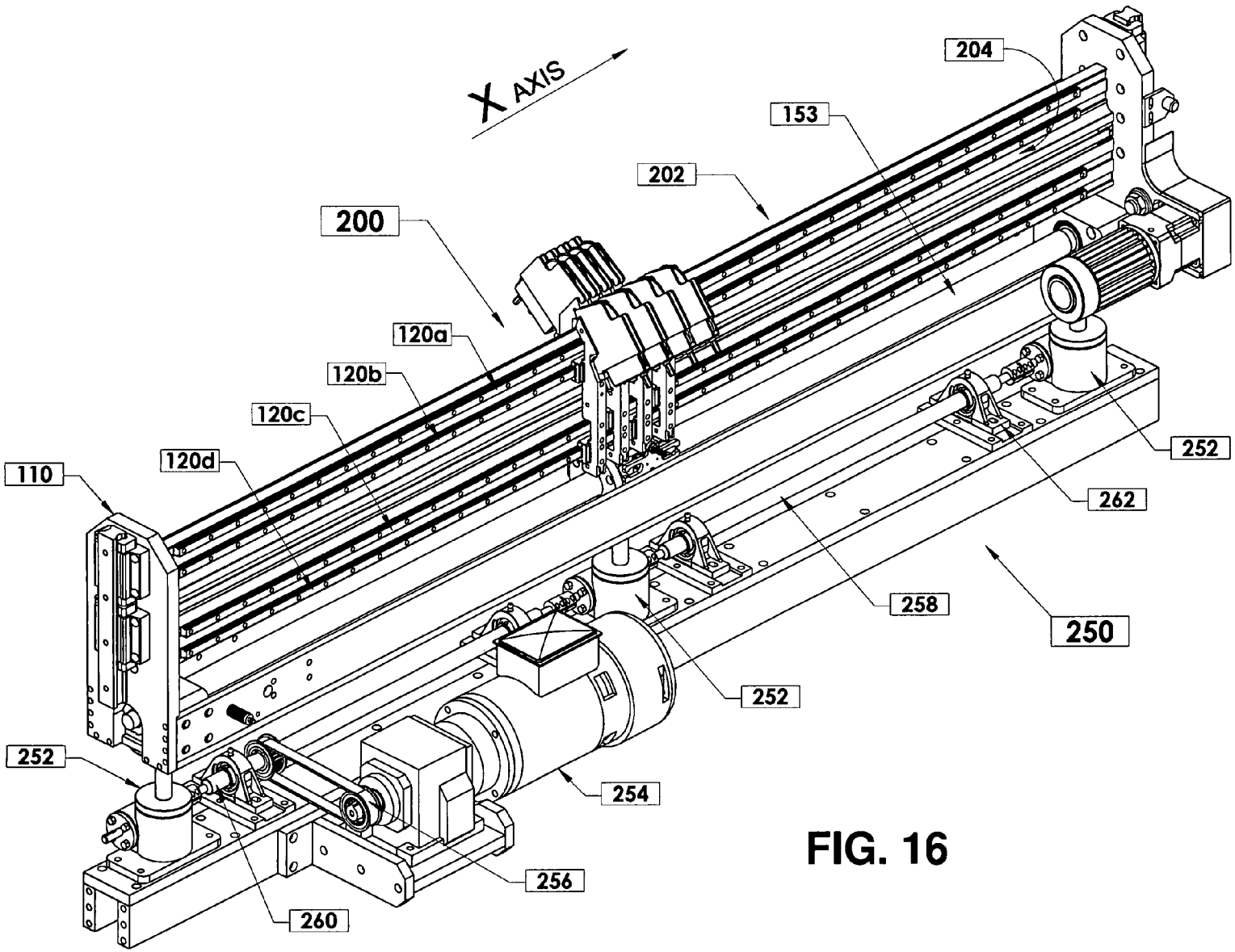
FIG. 16 is a view of the embodiment of FIG. 9 further depicting a lift assembly support operatively connected to the carriage assembly.

In accordance with a further aspect FIG. 16 is a view of the embodiment of FIG. 9 further depicting a lift assembly support 250 operatively connected to the carriage assembly 200. Specifically, lift assembly support 250 includes a plurality (e.g., three) adjustable mounting supports 252. As embodied herein, each mounting support 252 includes a vertically displaceable member, such as a power screw. The height of each mounting support 252 may be varied by rotating each power screw by interaction with a worm gear, for example, attached to shaft 260. Shaft 258, in turn, is caused to rotate by motor 254 via belt 256. Shaft 258 is supported by a plurality of journal bearings 262. Alternatively, supports 252 may be independently hydraulically or pneumatically actuated.

Figure 17A:
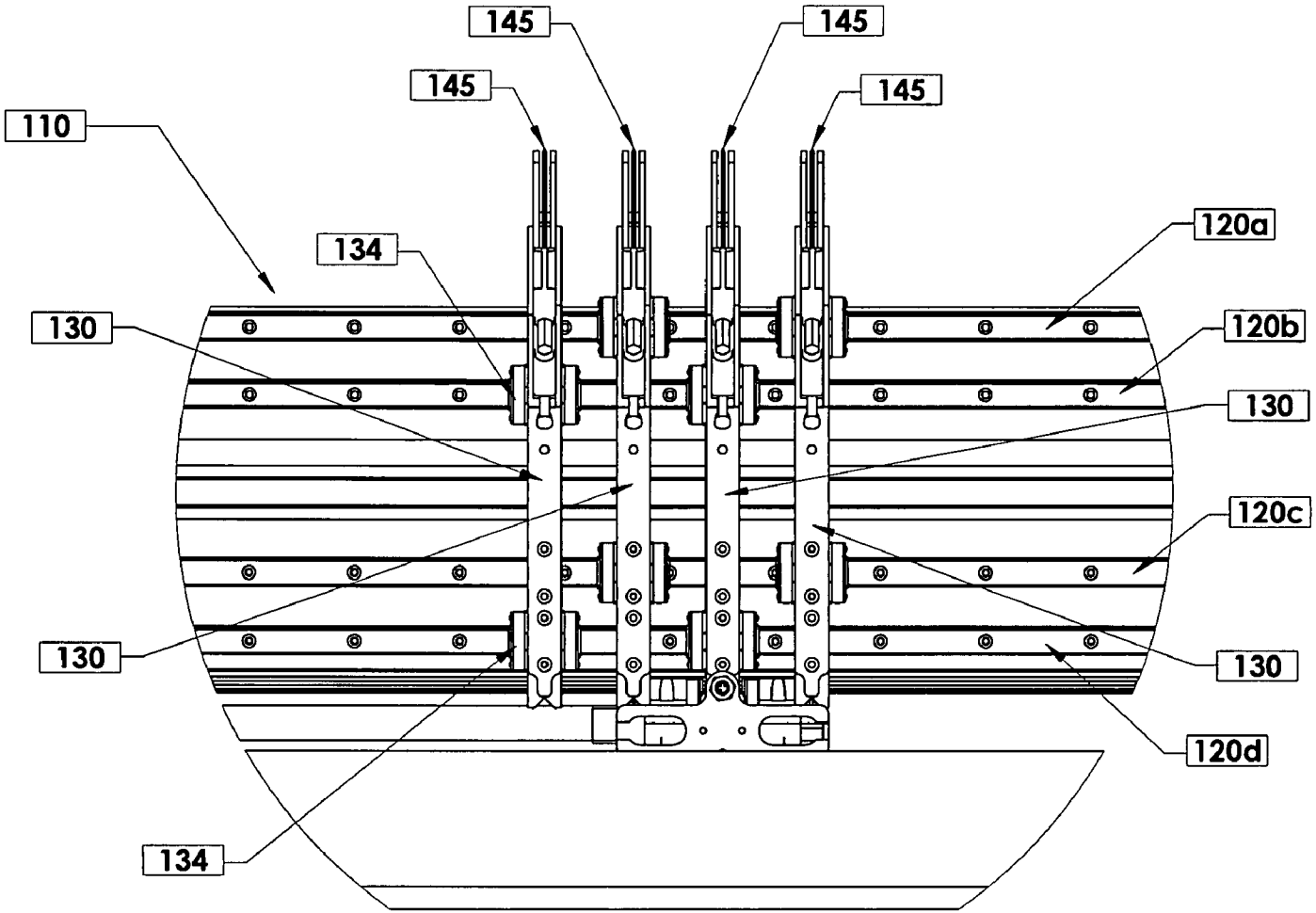
FIGS. 17(*a*)-17(*b*) are partial schematic views of the embodiment of FIG. 9 depicting a plurality of carriers in a spaced apart arrangement and a closed nested arrangement, respectively.
Figure 17B:
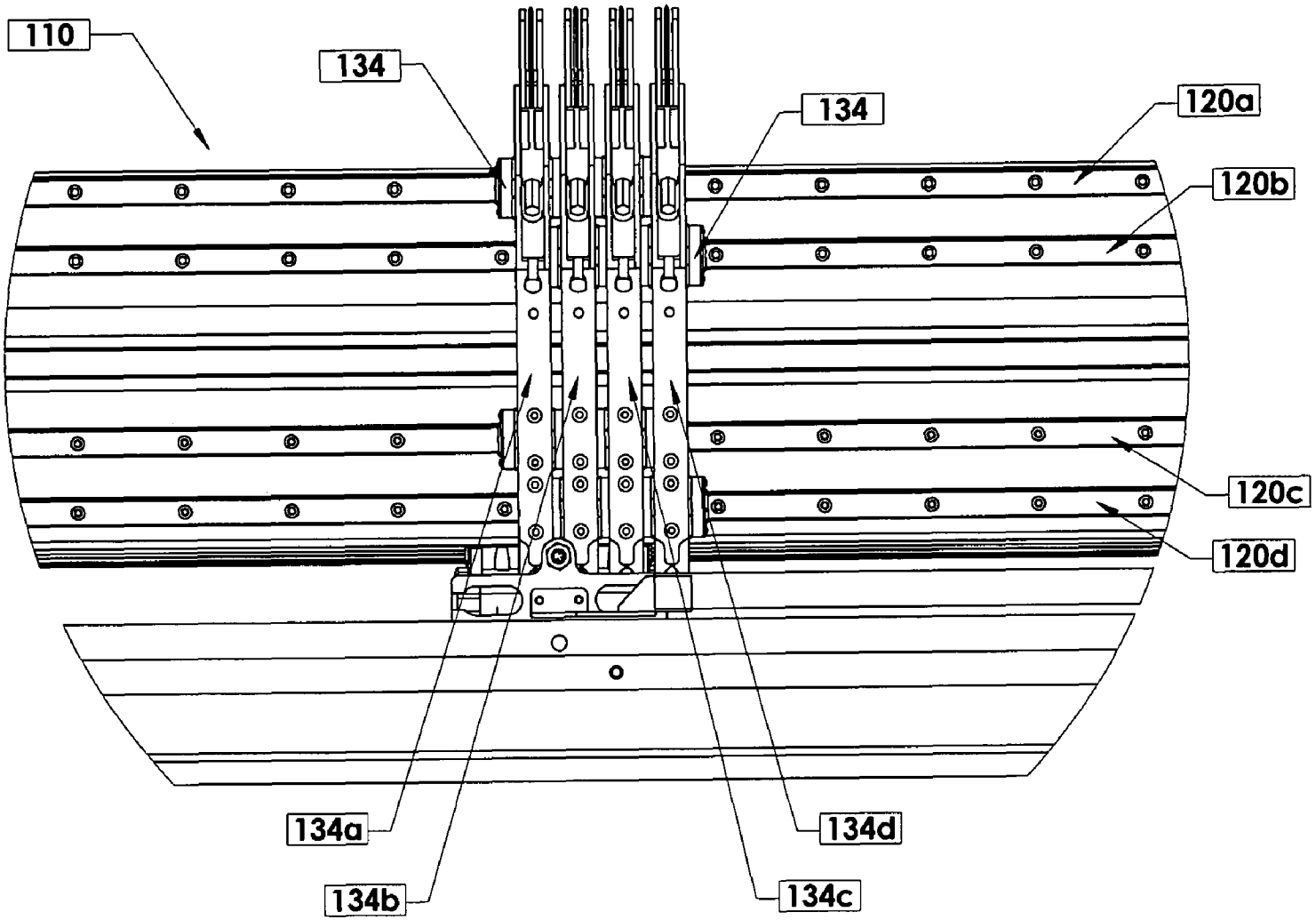

As with the embodiment of FIGS. 3-8, a first and second plurality of carriers 130 are provided on the rails 120, 220 of each wall 202, 204 of carriage 200. Each carrier 130 is configured and adapted to support a blade holder 140. As with the carriers 130 depicted in FIGS. 3-4 and 7-8, for example, each carrier 130 includes a first portion 136 having a first mounting feature 134 and a second portion 138 having a second mounting feature 134, wherein each mounting feature 134 is configured and adapted to receive one of the plurality of rails 120. As with the embodiment of FIGS. 3-4 and 7-8, the carriers 130 depicted in FIGS. 9(*a*)-9(*b*) are configured and adapted to collapse into a nested configuration, as shown in FIGS. 17(*a*) and 17(*b*). Moreover, FIG. 17(*b*) depicts how the mounting feature 134 of a first carrier 130*a* can be received by a recess in an adjacent carrier 130*b*. In further accordance with the embodiment of FIGS. 9(*a*)-9(*b*), mounting feature 134 is attached to each carrier 130 using a threaded fastener 133 (e.g., screws), as depicted in FIGS. 18(*a*)-18(*d*). However, recess portions of mounting features 134 can be integrally formed with the body of carrier as depicted in FIGS. 3-4 and 7-8.

Figure 18B:
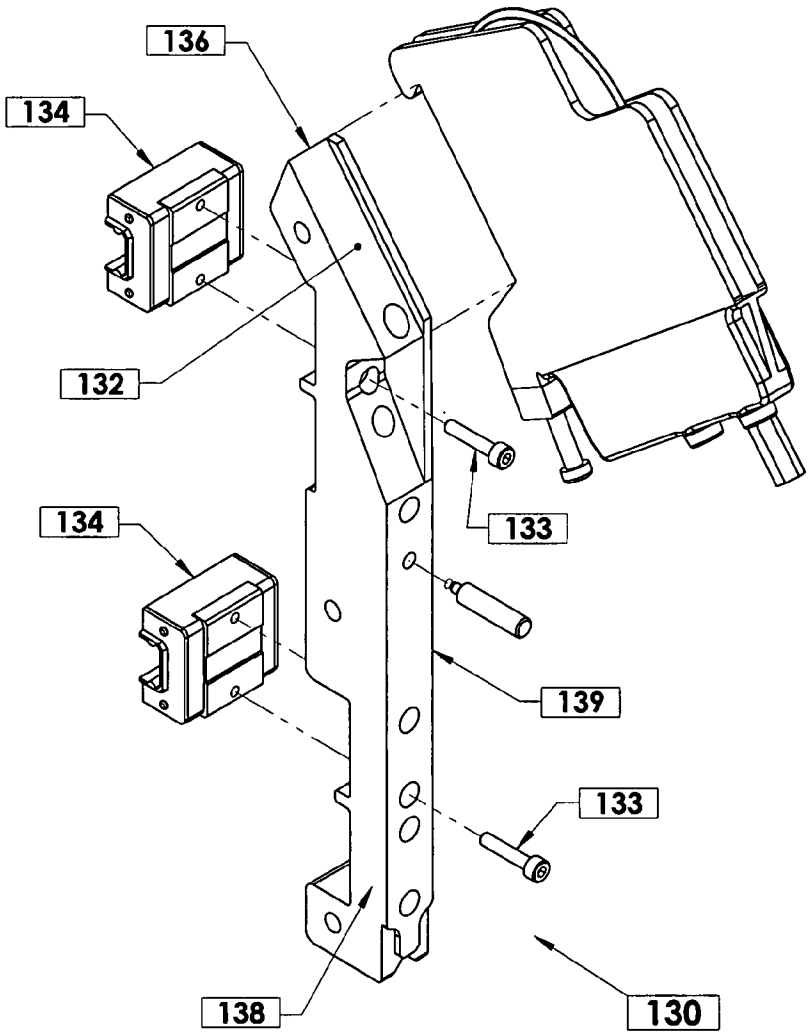
FIGS. 18(*a*)-18(*d*) depict various views of a carrier of the embodiment of FIG. 9.
Figure 18A:
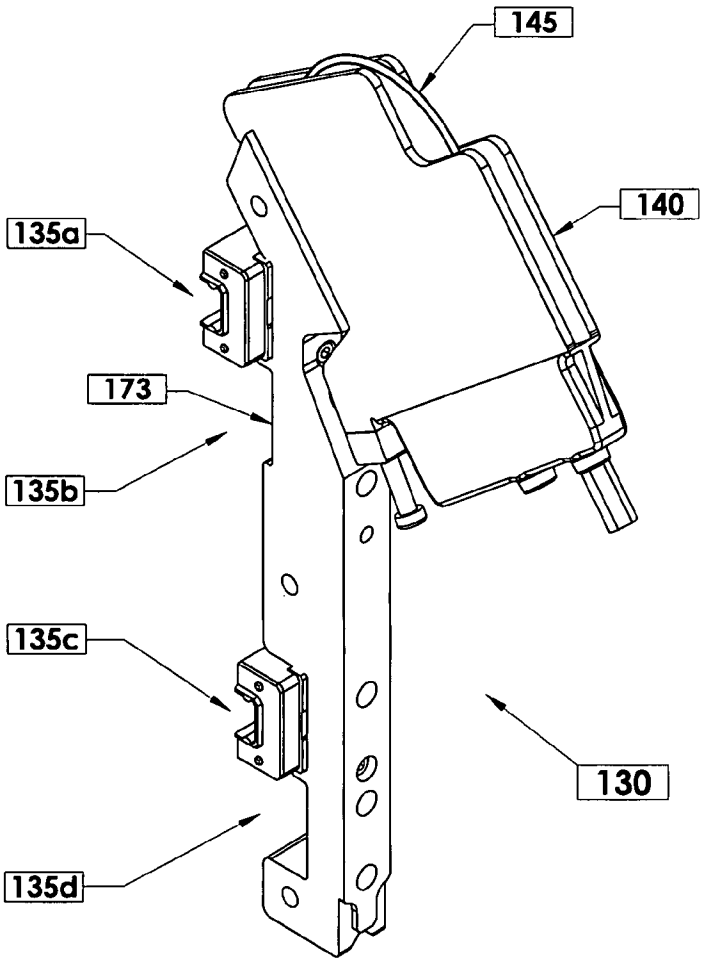
Figure 18D:
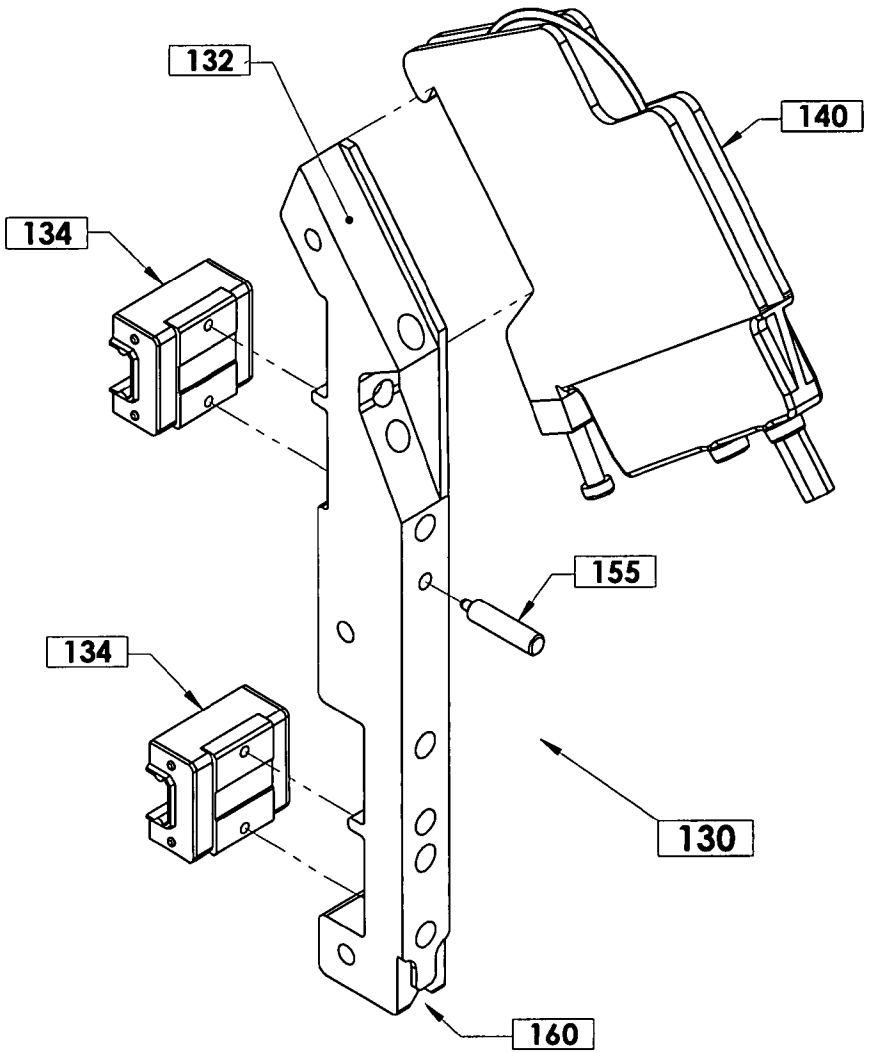
Figure 18C:
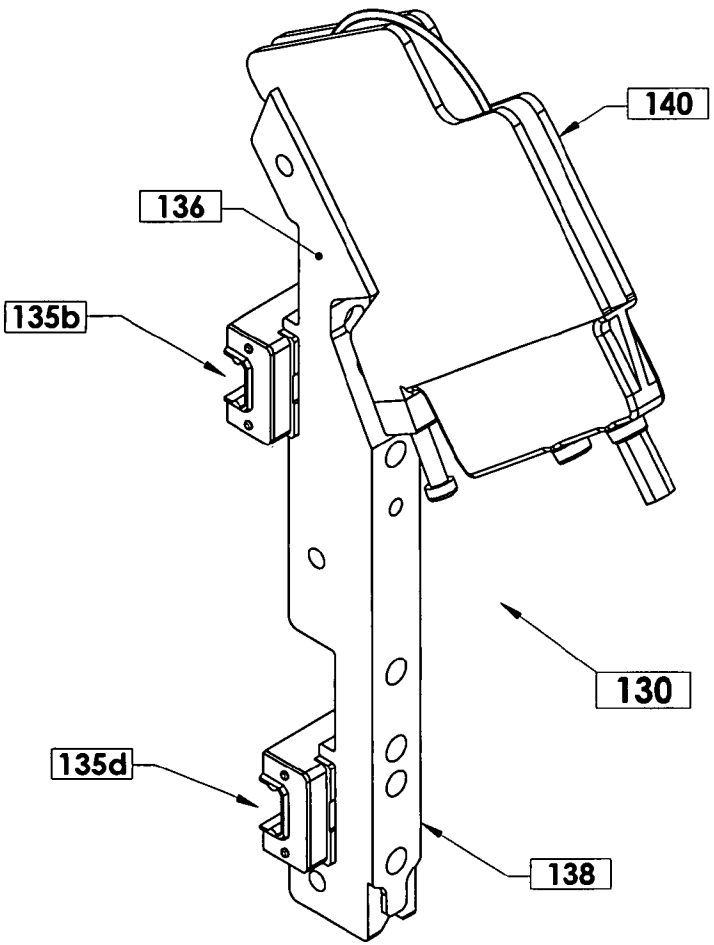

For purposes of further illustration, as shown in FIG. 18*a*, carrier 130 further includes an upper recess 173 in the second rail position 135*b* for accommodating passage of rail 120*b* as depicted in FIG. 17(*b*). Carrier 130 further includes a lower recess 174 in the fourth rail position 135*d* for accommodating rail 120*d* when the carriers 130 are in the nested position shown in FIG. 17(*b*). FIGS. 18(*a*)-18(*b*) depict mounting features 134 disposed in the first and third rail positions 135*a*, 135*c* of carrier 130, while FIGS. 18(*c*)-18(*d*) depict mounting features 134 disposed in the second and fourth rail positions 135*b*, 135*d* of carrier 130.

Figure 10:
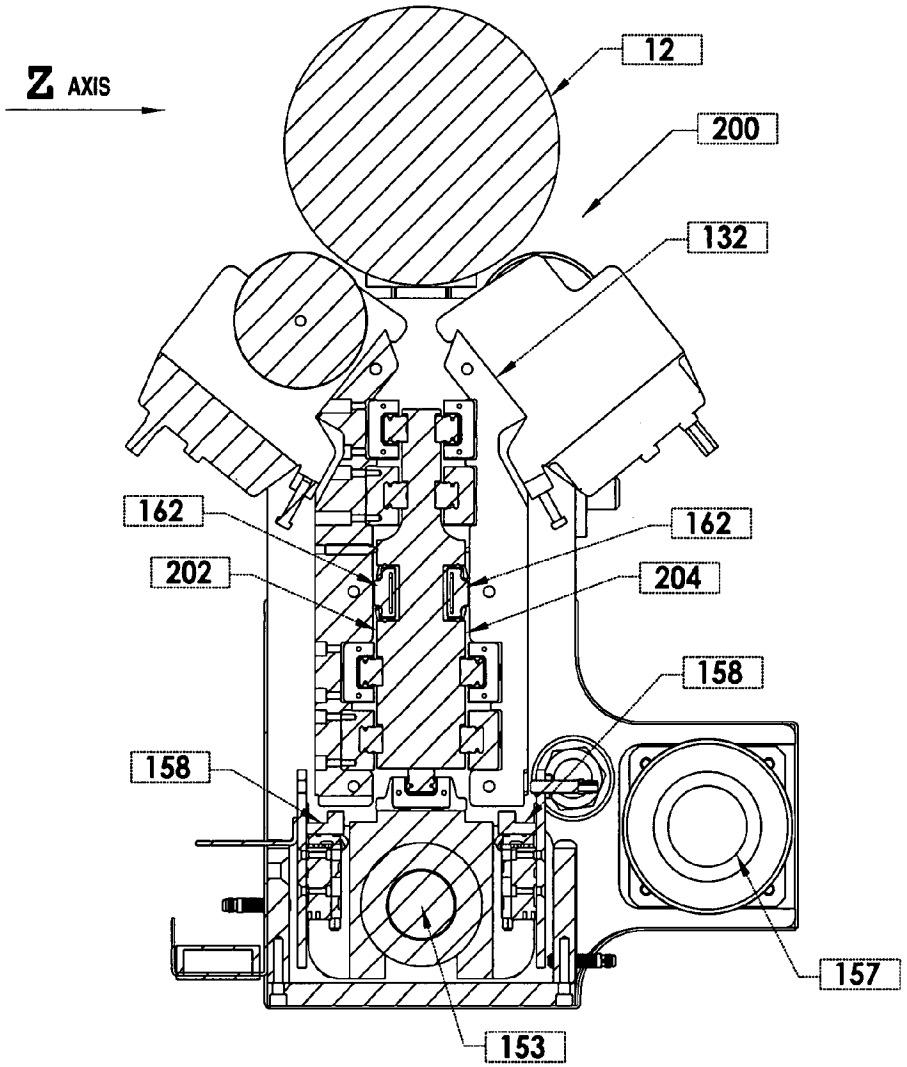
FIG. 10 is a schematic view of the embodiment of FIG. 9 with both banks of carriers disengaged from the positioner.
Figure 11:
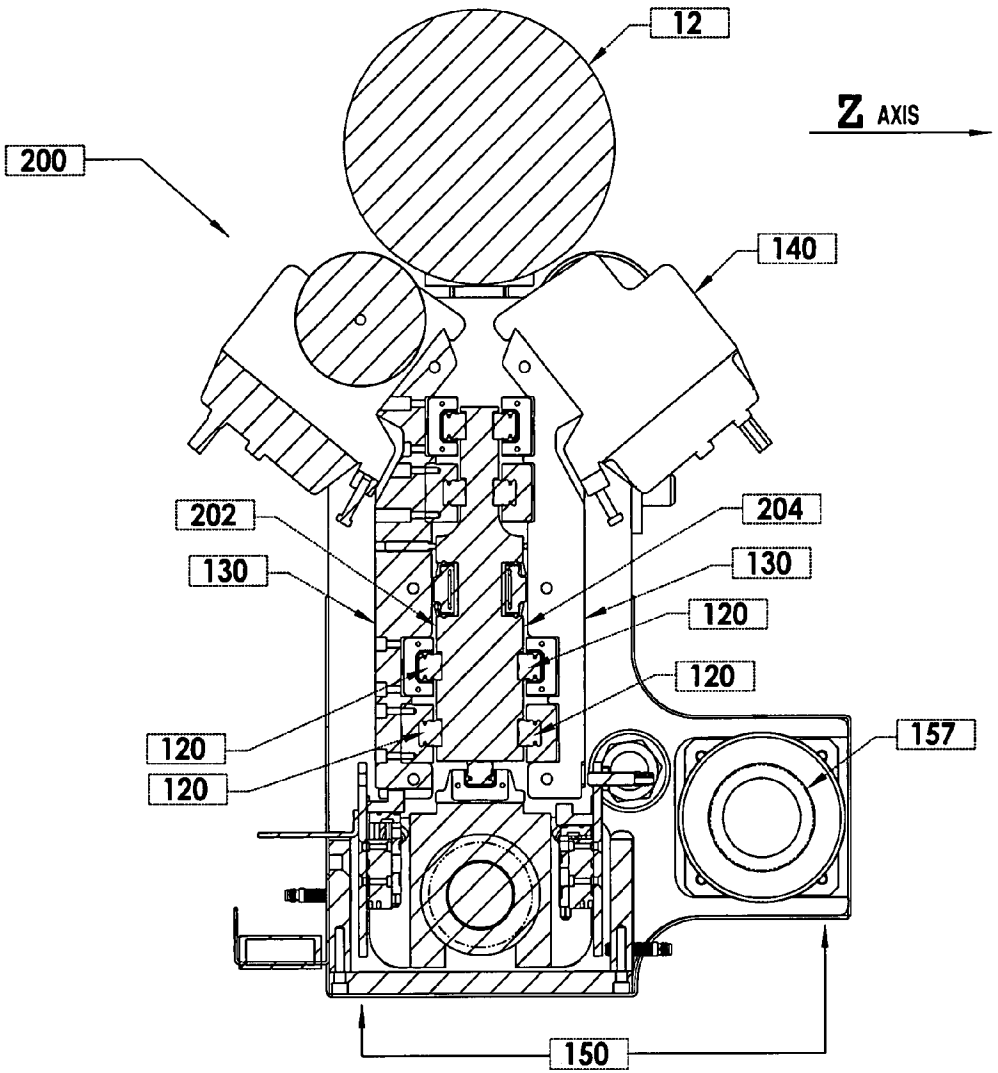
FIG. 11 is a schematic view of the embodiment of FIG. 9 with a first bank of carriers engaged with the positioner and a second bank of carriers disengaged from the positioner.

As depicted in FIGS. 9-12, linear actuator 152 is disposed below carriage assembly 200. The linear actuator 152 may be adapted and configured to selectively position each of a first carrier 130 of the first plurality of carriers and a second carrier from the second plurality of carriers in a desired location along the plurality of rails 120, 220 on each wall 202, 204. As depicted, positioner 156 includes two engagement members 158 deployable by (e.g., pneumatic) positioning cylinders 159 for selectively engaging each carrier 130 on either side 202, 204 of carriage 200. As provided herein, each carrier 130 may define a positioner receiving portion 160 for receiving an engagement member 158 of the positioner 156. A single linear actuator 152 can be provided, as depicted, or if desired, dual side-by-side linear actuators 152 can be provided. As with the embodiment of FIGS. 3-8, locking bladders 162 are provided to lock the carriers 130 in position in advance of performing a slitting operation, and the system 100 can be configured to verify the position of each of the carriers 130 both before and after inflation of bladders 162. FIG. 10 depicts the engagement members 158 withdrawn from the carriers 130 along both walls 202, 204. FIG. 11 illustrates the engagement member 158 withdrawn from the carriers 130 mounted along the second wall 204 and engaged with one of the carriers 130 mounted along the first wall 202. FIG. 12, conversely, depicts the engagement member 158 withdrawn from the carriers 130 mounted along the first wall 202 and engaged with one of the carriers 130 mounted along the second wall 204.

The system 100 of FIGS. 9(*a*)-9(*b*) can be preprogrammed and configured either manually, or in accordance with a computer readable program and computer system in a manner similar to the embodiment of FIGS. 3-8, but accounting for the second set of carriers 130 and blade holders 140. Advantageously, by using a dual-sided carriage 200, it is possible to slit a web into even thinner segments than with the embodiment of FIGS. 3-8, since twice as many blades are available to be positioned by positioner 156. As can be seen, this arrangement permits blade holders 140 on either side 202, 204 of carriage 200 to be staggered with respect to each other, permitting the minimum slit width to be reduced as compared to the embodiment of FIGS. 3-8. Moreover, by providing carriers 130 along two sets of rails 120, for a given amount of carriers 130, only half as much space is taken up on either side of carriage 200 by unused carriers. As a result, more carriers 130 can be stored when not in use, reducing the need to remove carriers 130 from carriage 200 if wider web sections need to be slit.

Controller 330 can be programmed to instruct the positioner 156 to selectively position the first carrier 130 and second carrier 130 along the plurality of rails in accordance with a setup configuration as described herein above. For example, the controller 330 can be configured to arrange the carriers 130 along the first wall 202 in alignment with carriers 130 displaced along the second wall 204. If desired, the carriers 130 along the first wall 202 can be out of alignment with carriers 130 displaced along the second wall 204. Moreover, the carriers 130 in each of the first plurality of carriers and second plurality of carriers can be in mutually supporting intimate contact as described herein. A locking bladder 162 can be provided to hold each carrier 130 in the system in position after being positioned by the positioner 156.

Although the automated knife positioning system and multi-rail carriage assembly with interfitting/nesting carriers have been described with respect to preferred embodiments, for example, with respect to a score slitting machine, those skilled in the art will readily appreciate that changes and modifications may be made thereto without departing from the spirit and scope of the subject invention.

The methods and systems of the present invention, as described above and shown in the drawings, provide for a converting machine with superior properties including added flexibility and ease of use, among other advantages described above. It will be apparent to those skilled in the art that various modifications and variations can be made in the device and method of the present invention without departing from the spirit or scope of the invention. Thus, it is intended that the present invention include modifications and variations that are within the scope of the appended claims and their equivalents.

What is claimed is:

1. A system for slitting a web of material comprising:

a) a score roll; and b) a carriage assembly, the carriage assembly including:

i) an elongate housing including a first wall surface defining a longitudinal axis, and a second wall surface disposed in an orientation opposite the first wall surface about an axis of symmetry perpendicular to a direction of travel of the web, the second wall surface facing away from the first wall surface with the first and second wall surfaces facing in substantially opposite directions and with the second wall surface being displaced from the first wall surface along the direction of travel of the web;

ii) at least one rail mounted on the first wall surface and extending parallel to the longitudinal axis;

iii) a first plurality of carriers disposed on the at least one rail mounted on the first wall surface, each carrier in the first plurality of carriers having a blade holder disposed thereon having a blade, the blades disposed on the first plurality of carriers being adapted and configured to engage the score roll aligned with the axis of symmetry;

iv) at least one rail mounted on the second wall surface and extending parallel to the longitudinal axis; and v) a second plurality of carriers disposed on the at least one rail mounted on the second wall surface, each carrier in the second plurality of carriers having a blade holder disposed thereon having a blade, the blades disposed on the second plurality of carriers being adapted to engage with the score roll, wherein the blades mounted on the rail on the first wall surface are angled toward and can move freely past the blades mounted on the rail on the second wall surface;

vi) a linear actuator having an elongate power screw including first and second ends rotatably disposed in bearings, the power screw being parallel to the axis of symmetry, the linear actuator further having a positioner including a threaded collar disposed on the power screw, the linear actuator further having a drive for rotating the power screw to cause linear movement of the positioner along the length of the power screw, the positioner being adapted and configured to selectively position each of a first carrier of the first plurality of carriers and a second carrier from the second plurality of carriers in a desired location along the first and second plurality of rails.

2. The system of claim 1, further including a fluid filled locking bladder adapted and configured to selectively lock each carrier in the system in position.

3. The system of claim 1, wherein:

a) the first carrier and second carrier each define a positioner receiving portion; and b) the positioner includes at least one engagement member for engaging the positioner receiving portion of each carrier, the at least one engagement member being displaceable between:

i) a first position where the engagement member is engaged with the positioner receiving portion; and ii) a second position where the engagement member is disengaged from the positioner receiving portion.

4. The system of claim 3, wherein the positioner receiving portion is defined at least in part by a concavity for receiving a rounded portion of the engagement member.

5. The system of claim 3, wherein:

the first carrier includes a marker; and the positioner further includes a position sensor for selectively locating the first carrier by detecting the marker.

6. The system of claim 5, wherein the marker is selected from the group consisting of optical markers and magnetic markers.

7. The system of claim 1, wherein at least one of the carriers includes a dovetailed mounting flange for supporting the blade holder.

8. The system of claim 1, wherein adjacent carriers are configured to nest together in mutually supporting intimate contact.

9. The system of claim 1 further comprising a control system, the control system including:

a controller including a processor and memory, the controller operatively associated with the linear actuator and positioner; the controller being programmed to instruct the positioner to selectively position at least one of the first plurality of carriers in a desired location along the plurality of rails.

10. The system of claim 9, wherein the controller is programmed to instruct the positioner to selectively position a first carrier of the plurality of carriers along the plurality of rails in accordance with a setup configuration.

11. The system of claim 10, wherein the controller is further programmed to prompt an operator of the system if more carriers are required to satisfy the setup configuration.

12. The system of claim 10, wherein the controller is further programmed to calculate the storage area and storage locations for carriers not needed to satisfy the setup configuration.

13. The system of claim 10, wherein the controller is further programmed to minimize the time necessary to execute the setup configuration.

14. The system of claim 13, wherein the controller minimizes the time necessary to execute the setup configuration at least in part by calculating the minimum number of moves needed to be made by the positioner.

15. The system of claim 13, wherein the controller is further programmed to send a series of commands to the positioner to cause the positioner to move the carriers to satisfy the setup configuration.

16. The system of claim 9, wherein the controller is selected from the group consisting of PLC based controllers and PC based controllers.

17. The system of claim 9, wherein the controller is programmed to compare a quantity of carriers in the system and a quantity of locations to position carriers needed to satisfy the setup configuration, wherein the setup configuration is a predetermined setup configuration stored in the memory.

18. The system of claim 9, wherein the controller is further programmed to send instructions to the positioner to scan the location of each carrier by using a position sensor operatively associated with the positioner.

19. The system of claim 18, wherein the controller is further programmed to determine whether each carrier has been positioned within a tolerance range.

20. The system of claim 19, wherein the controller is further programmed to perform additional moves to the carriers to achieve the tolerance range required to satisfy the setup configuration.

21. The system of claim 9, further including a graphical user interface operably coupled to the controller, the graphical user interface adapted and configured for displaying information and for receiving instructions from an operator.

22. The system of claim 21, wherein the graphical user interface is adapted and configured to facilitate storage and retrieval of a plurality of setup configurations.

23. The system of claim 9, wherein the controller is programmed to actuate one or more blades necessary to perform a desired web slitting operation.

24. The system of claim 9, further comprising:

a) a locking bladder adapted to selectively lock the carriers with respect to the set of rails; and b) wherein the control system includes a machine readable program containing instructions for controlling the system for slitting a web of material, wherein the program comprises:

i) means for instructing the positioner to selectively position at least one of the carriers in a desired location along the plurality of rails; and ii) means for selectively inflating and deflating the locking bladder to selectively lock the carriers in position with respect to the set of rails.

25. The system of claim 24, wherein the machine readable program further comprises means for instructing the positioner to selectively position at least one of the carriers in a desired location along the rails in accordance with a setup configuration.

26. The system of claim 25, wherein the machine readable program further comprises means for comparing the quantity of carriers in the system and the quantity of locations to position carriers needed to satisfy the setup configuration.

27. The system of claim 26, wherein the setup configuration is a predetermined setup configuration.

28. The system of claim 26, wherein the machine readable program further comprises means for prompting an operator if additional carriers are required to satisfy the setup configuration.

29. The system of claim 25, wherein the machine readable program further comprises means for calculating the storage area and storage locations for carriers not needed to satisfy the setup configuration.

30. The system of claim 25, wherein the program minimizes the time necessary to execute the setup configuration at least in part by calculating the minimum number of moves needed to satisfy the setup configuration.

31. The system of claim 25, wherein the machine readable program further comprises means for sending instructions to the positioner to scan the location of each carrier by using a position sensor operatively associated with the positioner.

32. The system of claim 24, wherein the machine readable program further comprises means for determining whether each carrier has been positioned within a tolerance range.

33. The system of claim 24, wherein the machine readable program further comprises means for actuating an electronically controlled air manifold operably coupled to the controller, the air manifold being pneumatically coupled to the carriers.

34. The system of claim 24, wherein the machine readable program further comprises means for pneumatically actuating a blade in each carrier from a first retracted position to a second extended position to perform a desired web slitting operation.

35. The system of claim 33, wherein the program further includes means to verify the position of each carrier after inflation of the locking bladder.

36. The system of claim 24, wherein the machine readable program further comprises means for verifying that a cut width does not exceed a width of the web of material to be cut.

37. The system of claim 24, wherein the machine readable program further comprises means for verifying that the cut width does not exceed a travel limit of the actuator based upon the position of a first carrier.

38. The system of claim 24, wherein the machine readable program further comprises means for performing an initial scan to determine the position of each selected carrier prior to moving the carriers with the positioner.

39. The system of claim 24, further comprising:

a) means for checking that the proper number of carriers are installed;

b) means for checking that the carriers that are installed are within predefined limits; and c) means for checking a store position of each blade.

40. The system of claim 1, wherein a blade mounted on the first plurality of carriers engages the score roll at a circumferentially discrete location from a blade mounted on the second plurality of carriers.

41. A system for slitting a web of material comprising:

a) a score roll; and b) a carriage assembly, the carriage assembly including:

i) an elongate housing including a first wall surface defining a longitudinal axis, and a second wall surface disposed in an orientation opposite the first wall surface about an axis of symmetry perpendicular to a direction of travel of the web, the second wall surface facing away from the first wall surface with the first and second wall surfaces facing in substantially opposite directions and with the second wall surface being displaced from the first wall surface along the direction of travel of the web;

ii) a first plurality of rails mounted on the first wall surface and extending parallel to the longitudinal axis;

iii) a first plurality of carriers disposed on the first plurality of rails, each carrier in the first plurality of carriers having a main body portion proximate the rails and a blade holder mounting portion extending beyond a top edge of the first wall surface for supporting a blade holder having a blade, the blade holder mounting portion being adapted and configured to angle the blade holder toward the second wall surface to facilitate engagement with the score roll;

iv) a second plurality of rails mounted on the second wall surface and extending parallel to the longitudinal axis;

v) a second plurality of carriers disposed on the second plurality of rails, each carrier in the second plurality of carriers having a main body portion proximate the rails and a blade holder mounting portion extending beyond a top edge of the second wall surface for supporting a blade holder having a blade, the blade holder mounting portion being adapted and configured to angle the blade holder toward the first wall surface to facilitate engagement with the score roll; and vi) a linear actuator having an elongate power screw including first and second ends rotatably disposed in bearings, the power screw being parallel to the axis of symmetry, the linear actuator further having a positioner including a threaded collar disposed on the power screw, the linear actuator further having a drive for rotating the power screw to cause linear movement of the positioner along the length of the power screw, the positioner being adapted and configured to selectively position each of a first carrier of the first plurality of carriers and a second carrier from the second plurality of carriers in a desired location along the first and second plurality of rails, wherein:

(1) the first carrier and second carrier each define a positioner receiving portion; and (2) the positioner includes at least one engagement member for engaging the positioner receiving portion of each carrier, the at least one engagement member being displaceable along a direction perpendicular to the power screw between a first position wherein the engagement member is extended from the positioner and engaged with the positioner receiving portion and a second position where the engagement member is retracted into the positioner and disengaged from the positioner receiving portion.

42. The system of claim 41, further including a fluid filled locking bladder adapted and configured to selectively lock each carrier in the system in position.

43. The system of claim 41, wherein at least one of the carriers includes a dovetailed mounting flange for supporting the blade holder.

44. The system of claim 41, wherein adjacent carriers are configured to nest together in mutually supporting intimate contact.

45. The system of claim 41, wherein the positioner receiving portion is defined at least in part by a concavity for receiving a rounded portion of the engagement member.

46. The system of claim 41, wherein:

the first carrier includes a marker; and the positioner further includes a position sensor for selectively locating the first carrier by detecting the marker.

47. The system of claim 46, wherein the marker is selected from the group consisting of optical markers and magnetic markers.

48. The system of claim 41, wherein blades mounted on the first plurality of carriers can move freely past blades mounted on the second plurality of carriers.

49. The system of claim 41, wherein a blade mounted on the first plurality of carriers engages the score roll at a circumferentially discrete location from a blade mounted on the second plurality of carriers.

50. A system for slitting a web of material comprising:

a) a score roll; and b) a carriage assembly, the carriage assembly including:

i) an elongate housing including a first wall surface defining a longitudinal axis, and a second wall surface disposed in an orientation opposite the first wall surface about an axis of symmetry perpendicular to a direction of travel of the web, the second wall surface facing away from the first wall surface with the first and second wall surfaces facing in substantially opposite directions and with the second wall surface being displaced from the first wall surface along the direction of travel of the web;

ii) at least one rail mounted on the first wall surface and extending parallel to the longitudinal axis;

iii) a first plurality of carriers disposed on the at least one rail mounted on the first wall surface, each carrier in the first plurality of carriers having a main body portion proximate the rails and a blade holder mounting portion for supporting a blade holder having a blade, the blade holder mounting portion being adapted and configured to facilitate engagement between a blade mounted in the blade holder and a score roll;

iv) at least one rail mounted on the second wall surface and extending parallel to the longitudinal axis;

v) a second plurality of carriers disposed on the at least one rail mounted on the second wall surface, each carrier in the second plurality of carriers having a main body portion proximate the rails and a blade holder mounting portion for supporting a blade holder having a blade, the blade holder mounting portion being adapted and configured to facilitate engagement between a blade mounted in the blade holder and the score roll; and vi) a linear actuator having an elongate power screw including first and second ends rotatably disposed in bearings, the power screw being parallel to the axis of symmetry, the linear actuator further having a positioner including a threaded collar disposed on the power screw, the linear actuator further having a drive for rotating the power screw to cause linear movement of the positioner along the length of the power screw, the positioner being adapted and configured to selectively position each of a first carrier of the first plurality of carriers and a second carrier from the second plurality of carriers in a desired location along the rails wherein:

(1) the first carrier and second carrier each define a positioner receiving portion; and (2) the positioner includes at least one engagement member for engaging the positioner receiving portion of each carrier, the at least one engagement member being displaceable along a direction perpendicular to the power screw between a first position wherein the engagement member is extended from the positioner and engaged with the positioner receiving portion and a second position where the engagement member is retracted into the positioner and disengaged from the positioner receiving portion.

51. The system of claim 50, further including a fluid filled locking bladder adapted and configured to selectively lock each carrier in the system in position.

52. The system of claim 50, wherein at least one of the carriers includes a dovetailed mounting flange for supporting the blade holder.

53. The system of claim 50, wherein at least one of the carriers is mounted on its respective at least one rail by way of a mounting feature including ball bearings.

54. The system of claim 50, wherein adjacent carriers are configured to nest together in mutually supporting intimate contact.

55. The system of claim 50, wherein the positioner receiving portion is defined at least in part by a concavity for receiving a rounded portion of the engagement member.

56. The system of claim 50, wherein:

the first carrier includes a marker; and the positioner further includes a position sensor for selectively locating the first carrier by detecting the marker.

57. The system of claim 56, wherein the marker is selected from the group consisting of optical markers and magnetic markers.

58. A system for slitting a web of material comprising:

a) a score roll; and b) a carriage assembly, the carriage assembly including:

i) an elongate housing including a first wall surface defining a longitudinal axis, and a second wall surface disposed in an orientation opposite the first wall surface about an axis of symmetry perpendicular to a direction of travel of the web, the second wall surface facing away from the first wall surface with the first and second wall surfaces facing in substantially opposite directions and with the second wall surface being displaced from the first wall surface along the direction of travel of the web;

ii) at least one rail mounted on the first wall surface and extending parallel to the longitudinal axis;

iii) a first plurality of carriers disposed on the at least one rail mounted on the first wall surface, each carrier in the first plurality of carriers having a blade holder mounted thereon having a blade, each blade being selectively deployable to engage the score roll at a first circumferential location on the score roll;

iv) at least one rail mounted on the second wall surface and extending parallel to the longitudinal axis;

v) a second plurality of carriers disposed on the at least one rail mounted on the second wall surface, each carrier in the second plurality of carriers having a blade holder mounted thereon having a blade, each blade being selectively deployable to engage the score roll at a second circumferential location on the score roll; and (vi) a linear actuator having an elongate power screw including first and second ends rotatable disposed in bearings, the power screw being parallel to the axis of symmetry, the linear actuator further having a positioner including a threaded collar disposed on the power screw, the linear actuator further having a drive for rotating the power screw to cause linear movement of the positioner along the length of the power screw, the positioner being adapted and configured to selectively position each of a first carrier of the first plurality of carriers and a second carrier from the second plurality of carriers in a desired location along the rails, wherein:

(1) the first carrier and second carrier each define a positioner receiving portion; and (2) the positioner includes at least one engagement member for engaging the positioner receiving portion of each carrier, the at least one engagement member being displaceable along a direction perpendicular to the power screw between a first position wherein the engagement member is extended from the positioner and engaged with the positioner receiving portion and a second position where the engagement member is retracted into the positioner and disengaged from the positioner receiving portion.

59. The system of claim 58, wherein the second circumferential location is radially displaced about the circumference of the score roll from the first circumferential location.

60. The system of claim 58, further including a fluid filled locking bladder adapted and configured to selectively lock each carrier in the system in position.

61. The system of claim 58, wherein at least one of the carriers includes a dovetailed mounting flange for supporting the blade holder.

62. The system of claim 58, wherein at least one of the carriers is mounted on its respective at least one rail by way of a mounting feature including ball bearings.

63. The system of claim 58, wherein adjacent carriers are configured to nest together in mutually supporting intimate contact.

64. The system of claim 58, wherein the positioner receiving portion is defined at least in part by a concavity for receiving a rounded portion of the engagement member.

65. The system of claim 58, wherein:

the first carrier includes a marker; and the positioner further includes a position sensor for selectively locating the first carrier by detecting the marker.

66. The system of claim 65, wherein the marker is selected from the group consisting of optical markers and magnetic markers.

67. The system of claim 58, wherein blades mounted on the first plurality of carriers can move freely past blades mounted on the second plurality of carriers.

* * * * *